US011767773B2

(12) United States Patent
Lahr

(10) Patent No.: US 11,767,773 B2
(45) Date of Patent: Sep. 26, 2023

(54) VALVE ACTUATION DEVICE FOR ACTUATING AT LEAST TWO GAS EXCHANGE VALVES OF AN INTERNAL COMBUSTION ENGINE, METHOD FOR OPERATING SUCH A VALVE ACTUATION DEVICE AND INTERNAL COMBUSTION ENGINE

(71) Applicant: Daimler Truck AG, Leinfelden-Echterdingen (DE)

(72) Inventor: Matthias Lahr, Schwaebisch Gmuend (DE)

(73) Assignee: Daimler Truck AG, Leinfelden-Echterdingen (DE)

( * ) Notice: Subject to any disclaimer, the term of this patent is extended or adjusted under 35 U.S.C. 154(b) by 0 days.

(21) Appl. No.: 17/783,553

(22) PCT Filed: Dec. 3, 2020

(86) PCT No.: PCT/EP2020/084548

§ 371 (c)(1),
(2) Date: Jun. 8, 2022

(87) PCT Pub. No.: WO2021/122046

PCT Pub. Date: Jun. 24, 2021

(65) Prior Publication Data

US 2023/0016116 A1 Jan. 19, 2023

(30) Foreign Application Priority Data

Dec. 19, 2019 (DE) ..... 10 2019 008 860.3

(51) Int. Cl.
*F01L 1/26* (2006.01)
*F01L 1/18* (2006.01)
(Continued)

(52) U.S. Cl.
CPC ..... *F01L 1/267* (2013.01); *F01L 1/181* (2013.01); *F01L 13/0005* (2013.01);
(Continued)

(58) Field of Classification Search
CPC ... F01L 1/181; F01L 1/267; F01L 1/46; F01L 13/0005
(Continued)

(56) References Cited

U.S. PATENT DOCUMENTS 7,789,065 B2 9/2010 Yang
10,309,273 B2 6/2019 Kim
(Continued)

FOREIGN PATENT DOCUMENTS

DE 102014205813 A1 * 10/2015 ..... F01L 1/26
DE 10 2016 119 635 A1 4/2017
(Continued)

OTHER PUBLICATIONS

PCT/EP2020/084548, International Search Report dated Mar. 4, 2021 (Three (3) pages).

*Primary Examiner* — Jorge L Leon, Jr.
(74) *Attorney, Agent, or Firm* — Crowell & Moring LLP

(57) ABSTRACT

A valve actuation device for actuating a first and second gas exchange valve of an internal combustion engine. A tilting lever is pivotable between a first starting position and a first actuation position and a valve bridge is movable between a second starting position and a second actuation position. A coupling device is switchable between a locking state, in which the valve bridge is movable out of the second starting position into the second actuation position via the coupling device by the tilting lever, and an unlocking state, in which, despite a movement of the tilting lever out of the first starting position into the first actuation position, there is no movement of the valve bridge out of the second starting
(Continued)

position into the second actuation position. The coupling device is held on the tilting lever such that the coupling device is pivotable with the tilting lever.

8 Claims, 17 Drawing Sheets

(51) Int. Cl.
*F01L 13/06* (2006.01)
*F01L 13/00* (2006.01)
*F01L 1/46* (2006.01)

(52) U.S. Cl.
CPC ..... *F01L 13/065* (2013.01); *F01L 1/46* (2013.01); *F01L 2001/467* (2013.01); *F01L 2013/105* (2013.01)

(58) Field of Classification Search
USPC ..... 123/90.4, 90.44
See application file for complete search history.

(56) References Cited

U.S. PATENT DOCUMENTS

| | | | | |
|---|---|---|---|---|
| 2010/0170472 | A1 | 7/2010 | Yang | |
| 2012/0024260 | A1 | 2/2012 | Groth et al. | |
| 2018/0058271 | A1 | 3/2018 | Baltrucki et al. | |
| 2021/0254562 | A1* | 8/2021 | McCarthy, Jr. ..... | F01L 13/06 |
| 2022/0307389 | A1* | 9/2022 | Edke ..... | F01L 13/065 |

FOREIGN PATENT DOCUMENTS

| | | | |
|---|---|---|---|
| EP | 2 425 105 | B1 | 3/2012 |
| EP | 2 439 381 | A1 | 4/2012 |
| EP | 3 012 440 | B1 | 4/2016 |
| WO | WO 2010/078280 | A2 | 7/2010 |
| WO | WO 2010/126479 | A1 | 11/2010 |

* cited by examiner

F-F

VALVE ACTUATION DEVICE FOR ACTUATING AT LEAST TWO GAS EXCHANGE VALVES OF AN INTERNAL COMBUSTION ENGINE, METHOD FOR OPERATING SUCH A VALVE ACTUATION DEVICE AND INTERNAL COMBUSTION ENGINE

BACKGROUND AND SUMMARY OF THE INVENTION

The invention relates to a valve actuation device for actuating at least two gas exchange valves of an internal combustion engine. Furthermore, the invention relates to a method for operating such a valve actuation device. The invention also refers to an internal combustion engine for a motor vehicle having at least one such valve actuation device.

EP 2 425 105 B1 discloses a system for actuating an outlet valve for decelerating the engine. Furthermore, a method for selectively actuating gas exchange valves in an internal combustion engine is known from EP 3 012 440 B1. Furthermore, US 2018/0058271 A1 discloses a system for actuating at least one of two or more gas exchange valves in an internal combustion engine. Furthermore, a device for modifying a stroke of gas exchange valves is known from U.S. Pat. No. 7,789,065 B2.

The object of the present invention is to create a valve actuation device, a method for operating such a valve actuation device and an internal combustion engine having at least one such valve actuation device, such that a particularly advantageous valve stroke shutoff can be implemented.

A first aspect of the invention relates to a valve actuation device for actuating at least two gas exchange valves of an internal combustion engine preferably formed as a reciprocal piston engine, in particular for a motor vehicle. The motor vehicle is formed, for example, as a car and here in particular as a utility vehicle and in its completely produced state comprises the internal combustion engine, by means of which the motor vehicle can be driven. Here, the internal combustion engine in its completely produced state comprises the valve actuation device. The valve actuation device comprises at least one first tilting lever, which can be pivoted around a pivoting axis between at least one first starting position and at least one first actuation position, in particular in relation to at least one housing element, in particular a cylinder head or a crank housing, of the internal combustion engine. To do so, the tilting lever is arranged rotatably on a tilting lever axis and can be pivoted around the pivoting axis in relation to the tilting lever axis between the first starting position and the first actuation position. For example, the tilting lever can be pivoted around the pivoting axis out of the first starting position into the first actuation position by means of a cam of a camshaft.

Moreover, the valve actuation device comprises at least one valve bridge that can be moved between at least one second starting position and at least one second actuation position, in particular in relation to the housing element mentioned above, by means of which valve bridge both a first of the gas exchange valves and a second of the gas exchange valves can be actuated by moving the valve bridge out of the second starting position into the second actuation position. In other words, if the valve bridge also simply referred to as the bridge is moved out of the second starting position into the second actuation position, then both the first and the second gas exchange valve are thus actuated. The respective gas exchange valve is, for example, an outlet valve via which a gas, such as air or an exhaust gas of the internal combustion engine, for example, can be led or guided out of a cylinder of the internal combustion engine into an exhaust gas tract also referred to as an outlet tract of the internal combustion engine. By actuating the respective gas exchange valve, the respective gas exchange valve can be move or is moved, for example, out of a closed position into at least one open position. By actuating the gas exchange valve, this carries out a stroke, for example, which is also referred to as a valve stroke. Preferably, the valve bridge and the tilt lever are components formed separately from each other.

The valve actuation device moreover comprises a coupling device, which can be switched between at least one locking state and at least one unlocking state. In the locking state of the coupling device, by moving the tilting lever from the first starting position into the first actuation position, the valve bridge can be moved via the coupling device by means of the tilting lever out of the second starting position into the second actuation position. In other words, if the tilting lever is moved or pivoted out of the first starting position into the first actuation position, while the coupling device is in its locking state, then the valve bridge is moved out of the second starting position into the second actuation position by means of the tilting lever via the coupling device. In doing so, both the first gas exchange valve and the second gas exchange valve, for example, are actuated via the valve bridge and via the coupling device by means of the tilting lever. Thus, both the first gas exchange valve and the second gas exchange valve can be actuated via the valve bridge and the coupling device by means of the same tilting lever common to the first gas exchange valve and the second gas exchange valve.

In the unlocking state, despite the movement of the tilting lever from the first starting position into the first actuation position, a movement of the valve bridge out of the second position into the second actuation position by means of the tilting lever via the coupling device is avoided. In other words, if the tilting lever is moved or pivoted out of the first starting position into the first actuation position while the coupling device is in its unlocking position, then a movement of the valve bridge out of the second starting position into the second actuation position is avoided. This means that, in the unlocking state of the coupling device, an actuation of the first gas exchange valve and the second gas exchange valve that is caused or can be caused by the valve bridge is avoided. Thus, in the or due to the unlocking state of the coupling device, a stroke shutoff of the gas exchange valves is caused or set, since, in the unlocking state of the coupling device, no stroke of the gas exchange valves is caused although the tilting lever is moved or pivoted out of the first starting position into the first actuation position. Such a stroke shutoff, in particular its fundamental principle, is described in EP 3 012 440 B1, for example.

However, in order to now be able to implement the stroke shutoff particularly advantageously and here, in particular, to avoid excessive loads of the valve actuation device, it is provided according to the invention that the coupling device is held on the tilting lever and can thus also be pivoted around the pivoting axis with the tilting lever, in particular in relation to the housing element mentioned above. In doing so, it is possible to couple or to link a switch of the coupling device from the unlocking state into the locking state and/or a switch of the coupling device from the locking state into the unlocking state with the or a movement of the tilting lever between the first actuation position and the first starting position, whereby a defined or clear switching of the coupling device can be ensured.

Preferably, the coupling device is received at least partially in a receiver of the tilting lever, formed for example as a through opening, and is thus held on the tilting lever and can thus be pivoted with the tilting lever around the pivoting axis, in particular in relation to the housing element and/or in relation to the tilting lever axis or shaft.

It has been shown to be particular advantageous when the coupling device has a switching element that can be moved in a movement direction in relation to the tilting lever, in particular translationally, the switching element being able to be moved, in particular shifted, in the movement direction in relation to the tilting lever between at least one locking position causing the at least one locking state and at least one unlocking position causing the at least one unlocking state.

Here, it has been shown to be particularly advantageous when the valve actuation device has an actuation element provided in addition to the coupling device, for example. Preferably, the actuation element and the tilting lever are formed as components formed separately from each other. The tilting lever and, with this, the coupling device and thus the switching element can be pivoted around the pivoting axis in relation to the actuation element. In other words, since the coupling deice is held on the tilting lever and can thus also be pivoted with the tilting lever around the pivoting axis, the tilting lever and the coupling device can be pivoted, in particular together or simultaneously, around the pivoting axis between the first actuation position and the first starting position, in particular in relation to the actuation element. By pivoting the tilting lever and the switching element of the coupling device out of the first actuation position into the first starting position, the switching element can be moved out of the locking position into the unlocking position by means of the actuation element. In doing so, pivoting the tilting lever can be linked or correlated, in particular directly, particularly precisely and in a defined manner with switching the coupling device, such that the coupling device can be switched in a defined and targeted manner between the unlocking state and the locking state and can be switched. In particular, it is possible thanks to or with the valve actuation device according to the invention to switch the coupling device, in particularly exclusively, during the base circle phase of the cam mentioned above. In particular, an unwanted switching of the coupling device can be avoided, while the tilting lever is actuate by means of the cam, i.e., is moved out of the first starting position into the first actuation position or is held in the first actuation position. The knowledge underlying the invention, in particular, is that when the coupling device is switched while the tilting lever is actuated by means of the cam, in particular by means of the cam elevation, this can result in very high loads of the valve actuation device. However, such high loads can now be safely avoided thanks to the invention, and so-called semi-switches of the coupling device are avoided, since a clear and defined switching of the coupling device during a base circle phase of a cam is ensured.

A further embodiment is characterised in that, by pivoting the tilting lever from the first actuation position into the first starting position, the actuation element can be moved, in particular can be pivoted, out of at least on active position into at least one withdrawal position. In the active position, the switching element can be moved by means of the actuation element out of the locking position into the unlocking position by pivoting the tilting lever and the switching element out of the first actuation position into the first starting position. In other words, if the tilting lever and, with this, the switching element are moved or pivoted out of the first actuation position into the first starting position, while the actuation element is in its active position, then the switching element is then moved by means of the actuation element out of the locking position of the switching element into the unlocking position of the switching element.

In the withdrawal position of the actuation element, despite a pivoting or a movement of the first tilting lever and the switching element out of the first actuation position into the first starting position, a movement of the switching element that can be caused or is caused by means of the actuation element out of the locking position into the unlocking position stops. In other words, if the tilting lever and, with this, the switching element are moved or pivoted out of the first actuation position into the first starting position while the actuation element is in its withdrawal position, then a movement of the switching element that can be caused or is caused by means of the actuation element from the locking position into the unlocking position stops. Since the actuation element can here be moved out of its active position into its withdrawal position by the tilting ever being moved out of the first actuation position into the first starting position, switching the coupling device, in particular out of the locking stat into the unlocking state and/or out of the unlocking stat into the locking states, can be linked or brought into correlation or connection in a targeted and defined manner with the pivoting of the tilting lever, such that unwanted half switches of the coupling device leading to excessive high loads of the valve actuation device can be safely avoided.

A further embodiment is characterised in that the valve actuation device has a movement element provided in addition to the coupling device and thus not belonging to the coupling device. The movement element is held on the first tilting lever and can thus also be pivoted with the tilting lever around the pivoting axis, in particular in relation to the housing and/or in relation to the tilting lever axis or the shaft. The movement element can be moved in a switching direction in relation to the tilting lever and in relation to the switching element or in relation to the coupling device, in particular translationally, between at least one movement position and at least one rest position, in particular hydraulically. For example, the switching direction runs obliquely or perpendicularly to the movement direction of the coupling device. In particular, the movement element can be moved translationally between the movement position and the rest position in relation to the tilting lever and in relation to the switching element. In the movement position of the movement element, the actuation element can be moved by means of the movement element out of the active position into the withdrawal position by pivoting the tilting lever and the movement element out of the first actuation position into the first starting position. In other words, if the tilting lever and, with this, the movement element are moved or pivoted out of the first actuation position into the first starting position while the movement element is in its movement position, then the actuation element is then moved out of the active position into the withdrawal position by means of the movement element. As a result, a movement of the switching element caused by the actuation element out of the locking position into the unlocking position stops, such that unlocking the coupling device, i.e., switching the coupling device out of the locking state into the unlocking state, stops. This means that the switching element then remains in its locking position, such that the coupling device remains in its locking state.

In the rest position of the movement element, despite a pivoting of the tilting lever and the movement element out of the actuation position into the first starting position, a movement of the actuation that can be caused or is caused by means of the actuation element out of the active position into the withdrawal position stops. In other words, if the tilting lever and, with this, the movement element are moved or pivoted out of the first actuation position into the first starting position while the movement element is in its rest position, then the actuation element is not moved out of the active position into the withdrawal position, but rather the actuation element remains in its active position. As a result, the switching element is moved by means of the actuation element out of the locking position into the unlocking position, whereby the coupling device unlocks, i.e., is switched or shifted out of the locking state into the unlocking state. In the unlocking state, the stroke lift-off is activated or set. In other words, by unlocking the coupling device, the stroke lift-off is activated. In the unlocking state of the coupling device, the stroke lift-off is deactivated. By using the movement element, the coupling device can be specifically and definitely switched, wherein the switching can simultaneously be coupled or linked to the pivoting or movement of the first tilting lever in a precise and definite manner.

In order to be able to move the movement element particularly precisely and quickly from the movement position into the rest position, it is provided in a further design of the invention that the movement element can be moved hydraulically out of the movement position into the rest position. In doing so, a specific and defined switching of the coupling device during the base circle phase can be ensured, such that excessive loads of the valve actuation device can be safely avoided.

In a particularly advantageous embodiment of the invention, the valve actuation device comprises at least one in particular mechanical spring element, by means of which a spring force can be provided. The movement element can be moved out of the rest position into the movement position by means of the spring force and thus by mean of the spring element. The feature that the spring element is preferably formed as a mechanical spring element, i.e., as a mechanical spring, can be understood, in particular, to mean that the spring element is a spring that is distinct from a gas spring and thus present bodily or physically. By using the hydraulic movability of the movement element out of the movement position into the rest position and by using the spring element to move the movement element out of the rest position into the movement position, a specific and defined and needs-based movement of the movement element can be ensured, such that the coupling device can be switched as needed between the locking state and the unlocking state.

Finally, it has proved to be particularly advantageous when the actuation element is formed as an in particular mechanical spring. Thus, the switching element can be actuated specifically and simultaneously without load, i.e., moved from the locking position into the unlocking position, such that excessive loads of the valve actuation device can be safely avoided.

A second aspect of the invention relates to a method for operating a valve actuation device according to the invention according to the first aspect of the invention. Advantages and advantageous designs of the first aspect of the invention can be seen as advantages and advantageous designs of the second aspect of the invention and vice versa.

A third aspect of the invention relates to an internal combustion engine, preferably formed as a stroke piston engine, for a motor vehicle. The internal combustion engine according to the third aspect of the invention comprises at least one valve actuation device according to the invention according to the first aspect of the invention. Advantages and advantageous designs of the first aspect and the second aspect of the invention can be seen as advantages and advantageous designs of the third aspect of the invention and vice versa.

Further advantages, features and details of the invention emerge from the description below of a preferred exemplary embodiment and by means of the drawings. The features and feature combinations mentioned above in the description and feature combinations and the features and feature combinations mentioned below in the description of the figure and/or shown only in the figures can be used not only in the respectively specified combination, but also in other combinations or on their own without leaving the scope of the invention.

DETAILED DESCRIPTION OF THE DRAWINGS

Figure 1:
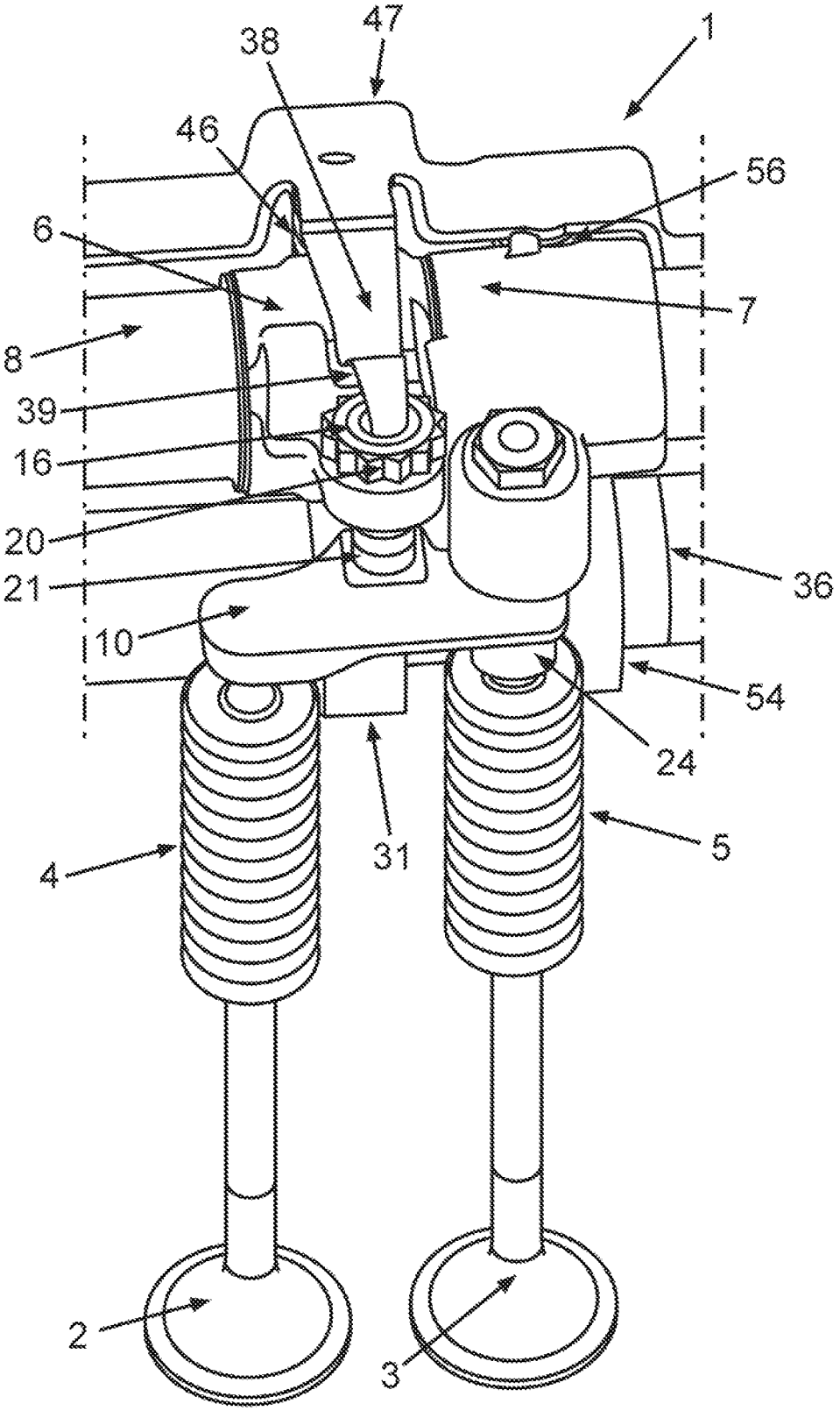
FIG. 1 is a schematic perspective view of a valve actuation device according to the invention.

In the figures, the same or functionally identical elements are provided with the same reference numerals.

In a schematic perspective view, FIG. 1 shows a valve actuation device 1 for actuating at least or exactly two gas exchange valves 2 and 3 of an internal combustion engine preferably formed as a stroke piston engine. This means that the internal combustion engine in its completely produced state has the valve actuation device 1. The internal combustion engine is, for example, a component of a motor vehicle, which in its completely produced state comprises the internal combustion engine and thus the valve actuation device 1. Here, the motor vehicle can be driven by means of the internal combustion engine. The motor vehicle is formed, in particular, as a utility vehicle. The internal combustion engine has at least one cylinder with a combustion chamber, wherein the combustion chamber is formed or delimited partially by the cylinder and partially by a piston received in the cylinder in a translationally moveable manner and partially by a cylinder head. The cylinder is formed or delimited by a cylinder wall. The cylinder wall forms a track along which the piston can glide and can thus be guided when the piston is moved translationally relative to the cylinder wall. The piston is flexibly coupled to a crankshaft of the internal combustion engine via a conrod, such that the translational movements of the piston are converted into a rotational movement of the crankshaft. Here, the crankshaft can be rotated around an axis of rotation in relation to a housing element, in particular a crank housing, of the internal combustion engine. In particular, the crankshaft is rotatably mounted in the crank housing. The internal combustion engine is here formed as a four-stroke engine, such that a respective work cycle of the internal combustion engine comprises exactly two complete rotations of the crankshaft and thus exactly 720 crank angles. The respective work cycle here comprises exactly four strokes of the internal combustion engine or the cylinder. A first stroke is a suction stroke, as part of which the piston is moved out of its upper dead centre, also referred to upper load alternation dead centre, into its lower dead centre. As part of the suction stroke, a gas comprising at least or exclusively air, for example, is introduced into the combustion chamber of the cylinder, in particular sucked in by means of the piston. A second stroke following the first stroke is a so-called compaction or compression stroke, as part of which the piston is moved out of its lower dead centre into its upper dead centre, also referred as an upper ignition dead centre, and compresses the filling in the combustion chamber.

A third stroke following the second stroke is a so-called working stroke, as part of which the piston is moved out of its upper ignition dead centre into its lower dead centre. The fourth stroke following the third stroke is a so-called outlet stroke or expulsion stroke, as part of which the piston is moved out of its upper dead centre into its upper charge alternation dead centre. Here, the gas exchange valves 2 and 3 are allocated to the cylinder, i.e., to the same cylinder, and are received in the cylinder head. Presently, the gas exchange valves 2 and 3 are formed as outlet valves, via which a gas or exhaust gas from the combustion chamber of the cylinder can flow via at least one outlet channel in the cylinder head into an exhaust gas tract of the internal combustion engine. The respective gas exchange valve 2 or 3 can be moved between a respective closed position and at least one respective open position, in particular translationally. With its movement out of the respective closed position into the respective open position, the respective gas exchange valve 2 or 3 carries out a stroke, also referred to as a valve stroke, which can be switched on and switched off particularly advantageously by means of the valve actuation device 1. Switching off the respective valve stroke is also referred to as stroke shutoff or valve stroke shutoff.

A respective valve spring 4 or 5 is allocated to the respective gas exchange valve 2 or 3. In the respective open position of the respective gas exchange valve 2 or 3, the respective valve spring 4 or 5 is tensioned, such that the respective valve spring 4 or 5 in the respective open position provides a respective spring force. The respective gas exchange valve 2 or 3 is moved or can be moved out of the respective open position into the respective closed position by means of the spring force and thus by means of the respective valve spring 4 or 5. In particular, the respective gas exchange valve 2 or 3 can be held in the respective closed position by means of the respective valve spring 4 or 5. Thus, if the gas exchange valves 2 and 3 are actuated by means of the valve actuation device 1, i.e., are moved out of the respective closed position into the respective open position, the gas exchange valves 2 are 3 are moved in opposition to the valve springs 4 and 5, i.e., in opposition to the spring forces provided by the valve springs 4 and 5, out of the respective closed position into the respective open position, in particular translationally. In particular, the gas exchange valves 2 and 3 can be moved in relation to the housing element mentioned above or in relation to the cylinder head of the internal combustion engine, in particular translationally, between the closed position and the open position. The cylinder head and the crankshaft housing are housing elements of the internal combustion engine formed separately from each other and connected to each other.

Figure 10:
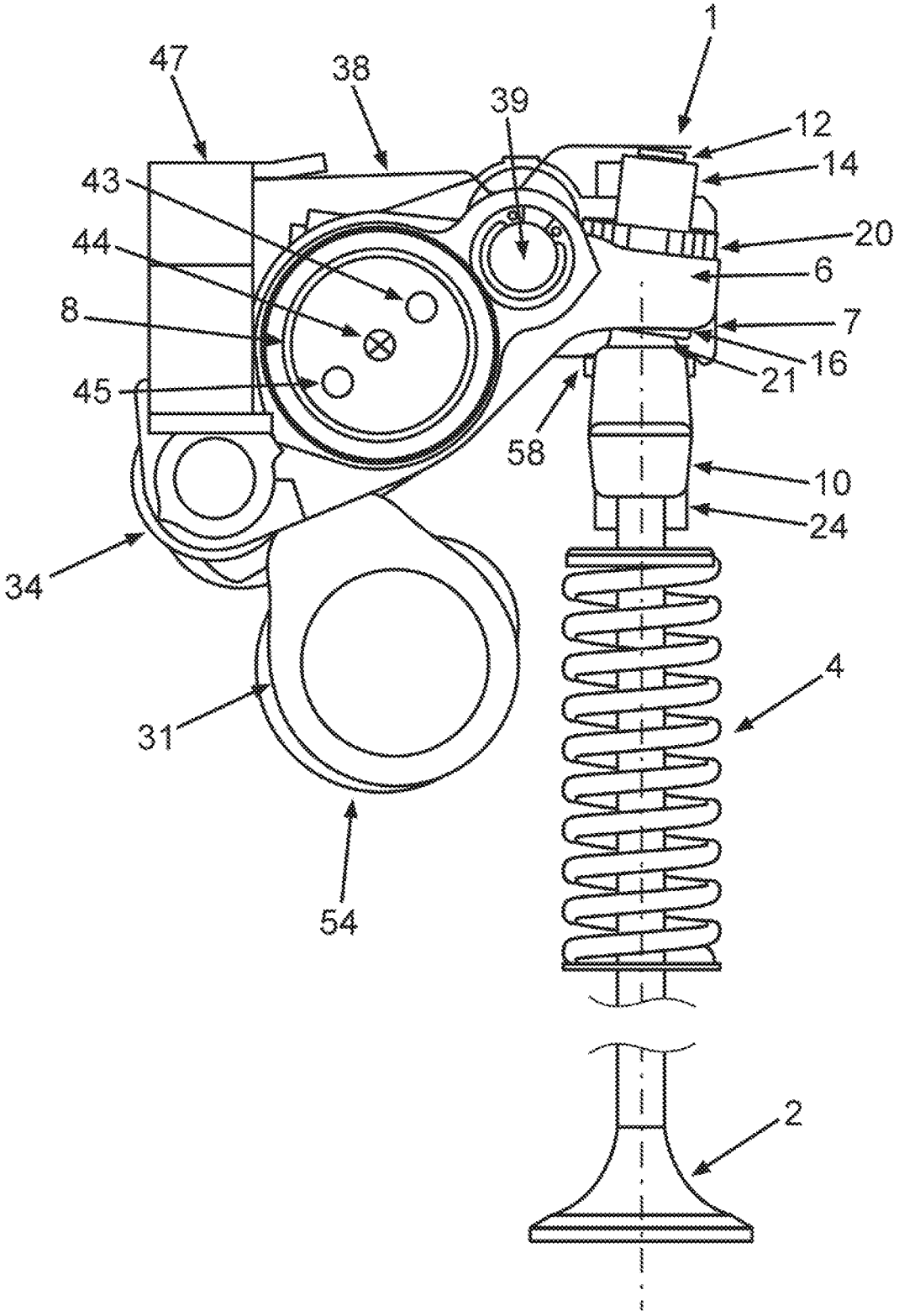
FIG. 10 is a further schematic lateral view of the valve actuation device, the coupling device of which is in its unlocking state.
Figure 11:
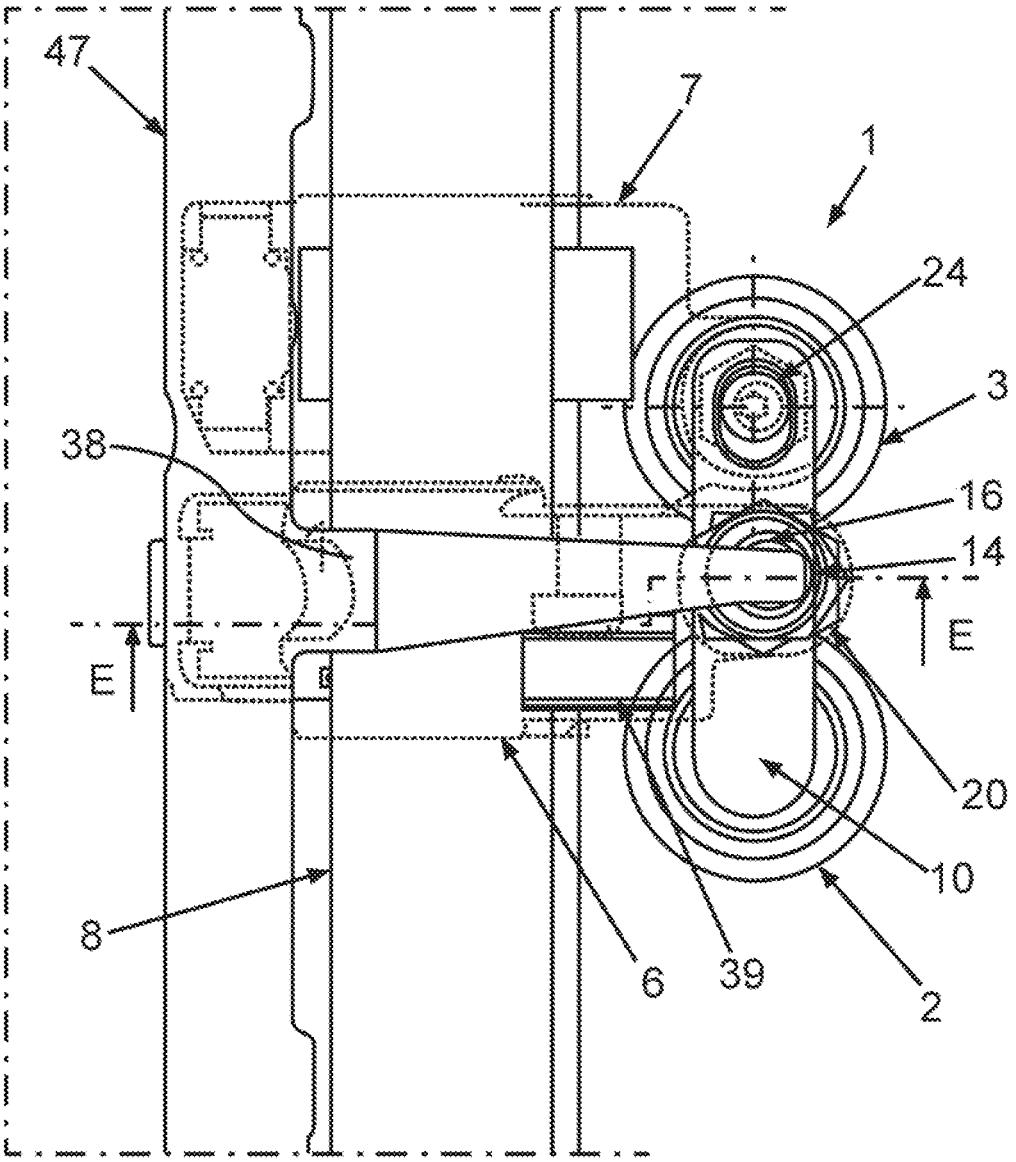
FIG. 11 is a schematic top view of the valve actuation device having transparently depicted tilting levers according to FIG. 10.

The valve actuation device 1 has at least one first tilting lever 6 common to the gas exchange valves 2 and 3, which is also referred to as the outlet tilting lever. Moreover, the valve actuation device 1 comprises a second tilting lever 7, which is also referred to as the braking tilting lever. The tilting levers 6 and 7 are formed separately from each other. Moreover, the tilting levers are arranged on a tilting lever axis 8 common to the tilting levers 6 and 7. Thus, the tilting levers 6 and 7 can be pivoted around a pivoting axis 9 that can be seen from FIG. 2 in relation to the tilting lever axis 8. In particular, the tilting levers 6 and 7 can be pivoted around the pivoting axis 9 in relation to each other and in relation to the tilting lever axis 8. The outlet tilting lever (first tilting lever 6) can be pivoted between at least one first actuation position that can be seen particularly well from FIGS. 10 and 12 around the pivoting axis 9 in relation to the tilting lever axis 8 and, in particular, in relation to the braking tilting lever (second lilting lever 7).

Moreover, the valve actuation device 1 comprises a valve bridge 10 common to the gas exchange valves 2 and 3 and formed separately from the tilting levers 6 and 7 and also simply referred to as the bridge, which can be moved between at least one second starting position that can be seen from FIGS. 2, 4, 6 and 8 and a second actuation position. Both the gas exchange valve 2 and the gas exchange valve 3 can be actuated by means of the valve bridge 10 by moving the valve bridge 10 out of the second starting position into the second actuation position and thus can be moved out of the respective closed position into the respective open position. The valve actuation device 1 moreover comprises a coupling device 11 which can be seen particularly well in FIGS. 4, 8 and 12 and which can be switched, i.e., shifted, between at least one locking state that can be seen particularly well from FIG. 4 and at least one unlocking state that can be seen particularly well from FIGS. 8 and 12. In the locking position, the valve bridge 10 can be moved via the coupling device 11 out of the second starting position into the second actuation position by moving the outlet tilting lever 6 out of the first starting position into the first actuation position. In other words, if the outlet tilting lever 6 is moved or pivoted out of its first starting position into its first actuation position while the coupling device 11 is in its locking state, the valve bridge 10 is moved out of the second starting position into the second actuation position, whereby the gas exchange valves 2 and 3 are actuated, i.e., opened.

In the unlocking state of the coupling device 11, a movement of the valve bridge 10 that can be caused or is caused by means of the outlet tilting lever 6 via the coupling device 11 out of the second starting position into the second actuation position stops despite a movement or despite a pivoting of the outlet tilting lever 6 out of the first starting position into the first actuation position. In other words, if the first outlet tilting lever 6 is moved or pivoted out of the first starting position into the first actuation position while the coupling device 11 is in its unlocking state, the a movement of the valve bridge 10 caused by the outlet tilting lever 6, in particular the coupling device 11, out of the second starting position into the second actuation position stops; instead the valve bridge 10 remains in its second starting position, wherein an actuation of the gas exchange valves 2 and 3 stops, although the outlet tilting lever 6 is pivoted out of the first starting position into the first actuation position. As a result, the gas exchange valves 2 and 3 are not actuated, i.e., not opened, such that an actuation or an opening of the gas exchange valves 2 and 3 stops.

Figure 4:
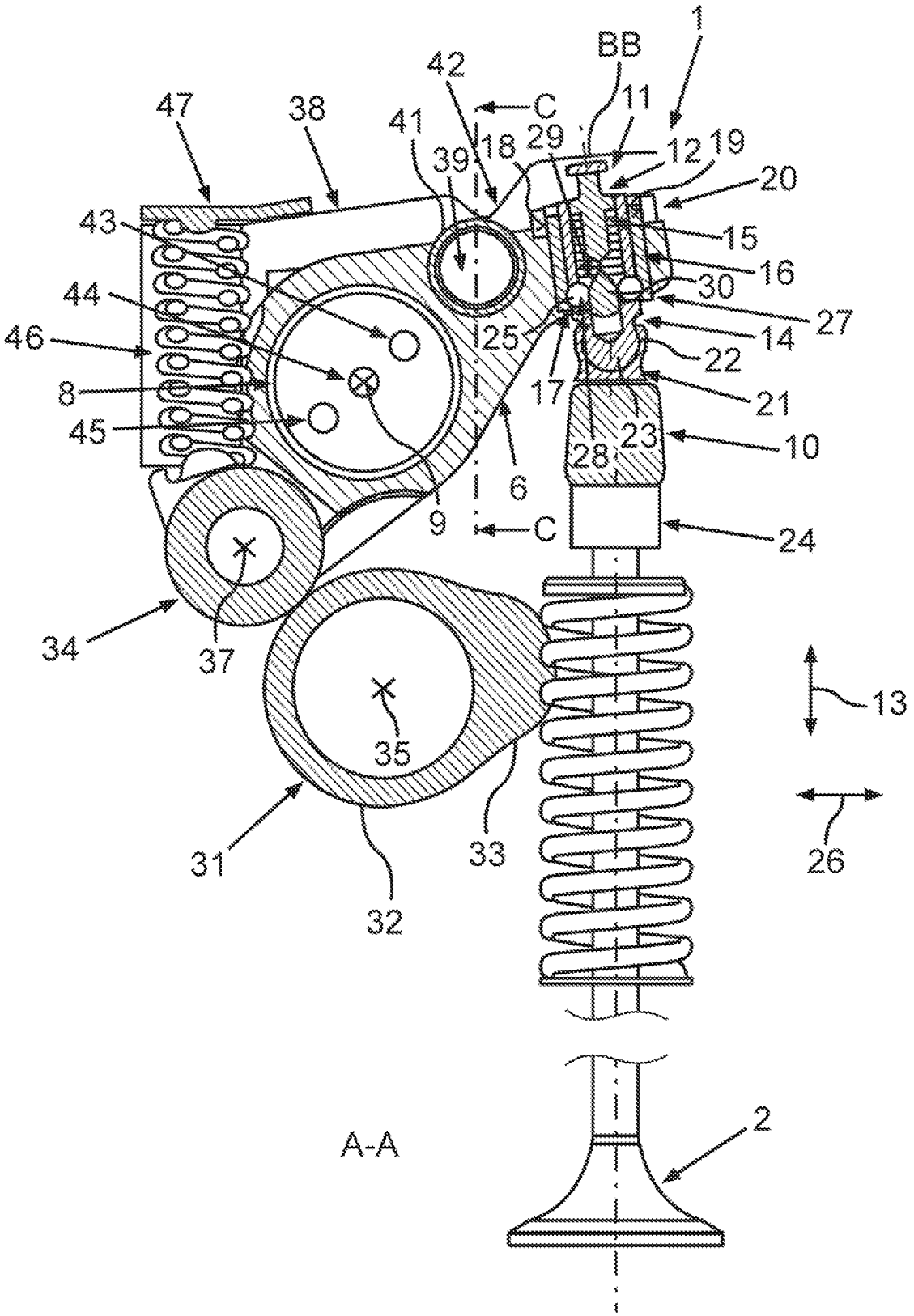
FIG. 4 is a schematic and cut-out lateral view of the valve actuation device along a cutting line A-A shown in FIG. 3.
Figure 8:
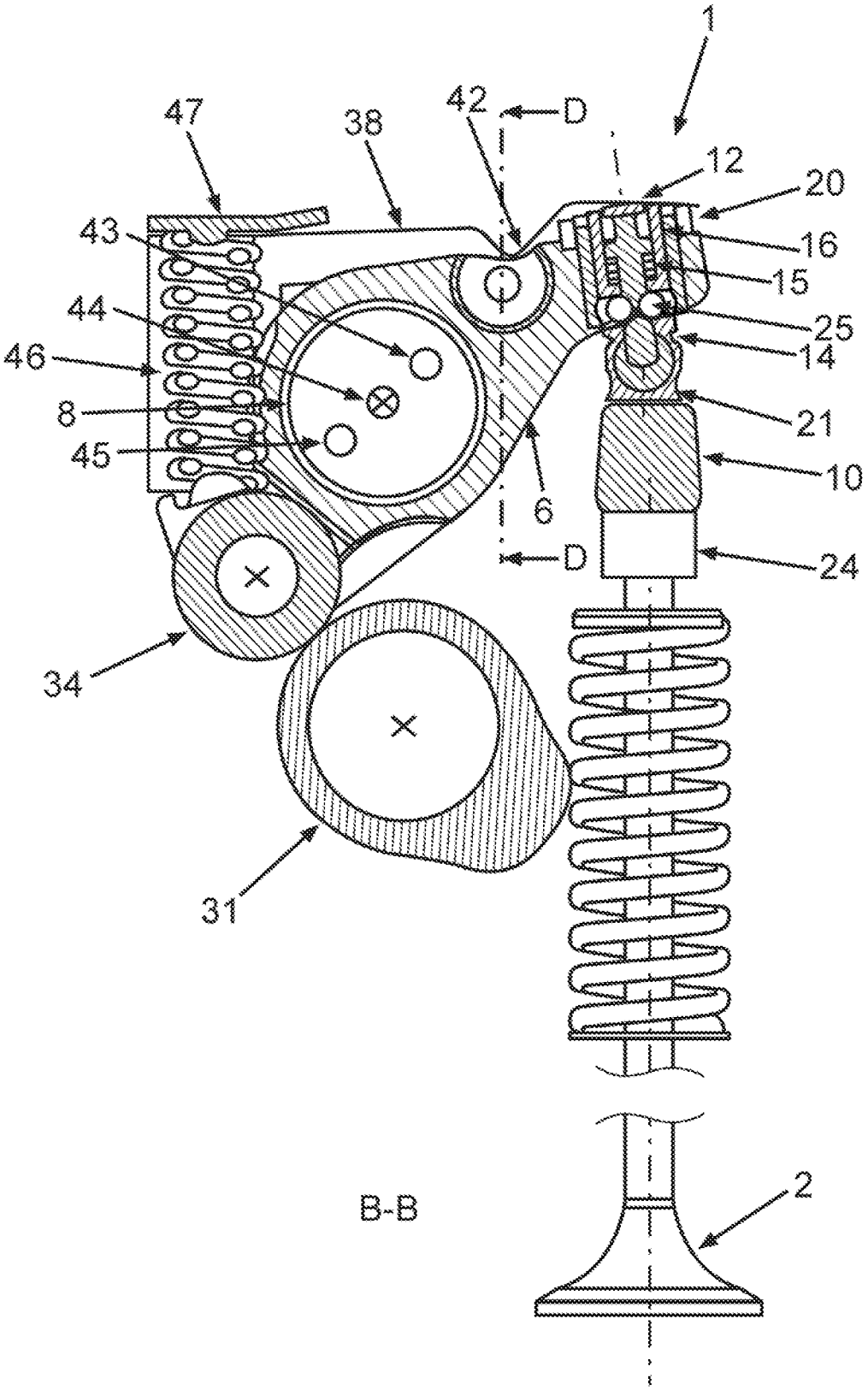
FIG. 8 is a schematic cut-out view of the valve actuation device along a sectional line B-B shown in FIG. 7.
Figure 12:
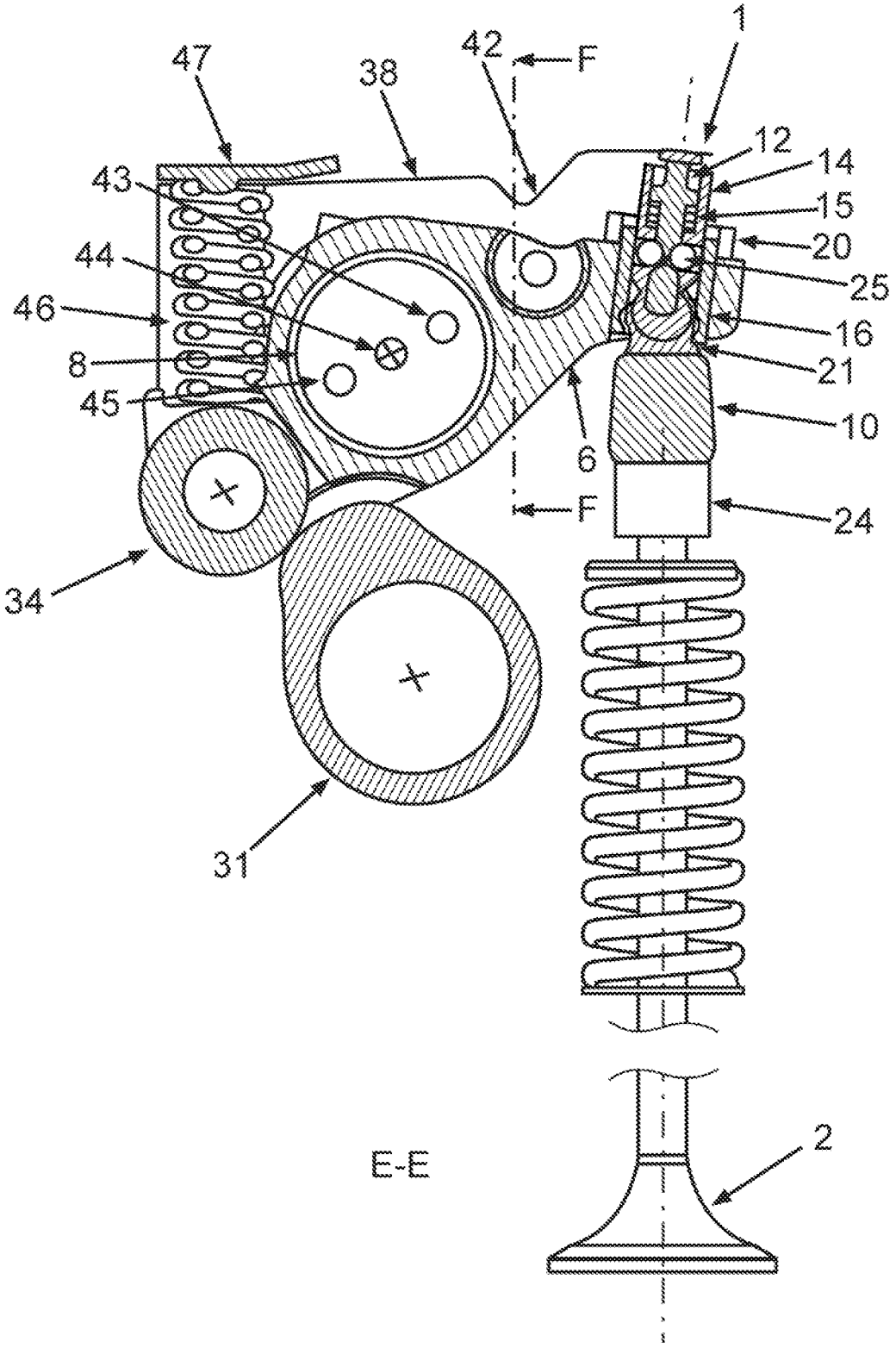
FIG. 12 is a schematic sectional view of the valve actuation device along a sectional line E-E shown in FIG. 11.

In order to now switch particularly advantageously and here in particular in a targeted and defined manner between the unlocking state and the locking state and to here be able to safely avoid excessive loads of the valve actuation device 1, the coupling device 11—as can be seen particularly well from FIG. 4, for example—is held on the outlet tilting lever 6 and can thus also be pivoted around the pivoting axis 9 with the outlet tilting lever 6, in particular in relation to the tilting lever axis 8. It can be seen particularly well from FIGS. 4, 8 and 12 that the coupling device 11 has a switching element 12, which is presently formed as a pin or piston, in particular an inner piston, of the coupling device 11. The switching element 12 can be moved translationally in a movement direction illustrated by a double arrow 13 in relation to the outlet tilting lever 6. Here, the switching element 12 can be moved in the movement direction in relation to the outlet tilting lever 6 between at least one locking position that can be seen in FIG. 4 and causes the locking state of the coupling device 11 and at least one unlocking position that can be seen in FIGS. 8 and 12 and causes the unlocking state of the coupling device 11, in particular can be shifted. Here, the coupling device 11 moreover comprises a second switching element 14, which is, for example, a second piston, in particular an outer piston, of the coupling device 11. The switching element 12 can here be moved in a movement direction in relation to the switching element 14, in particular translationally, between the unlocking position and the locking position. Moreover, the switching element 12 is received at least partially in the switching element 14. If the switching element 12 is moved out of the locking position into the unlocking position in relation to the switching element 14, in particular shifted, then at least one partial region of the switching element 12 is moved into the switching element 14, wherein the partial region of the switching element 12 is received in the unlocking position outside the switching element 14. Thus, if the switching element 12 is moved out of the unlocking position into the locking position, then the partial region is moved out of the switching element 14. Overall, it can be seen that the switching element 12 is received at least partially in the switching element 14 both in the locking position (FIG. 4) and in the unlocking position (FIGS. 8 and 12).

Moreover, the coupling device 11 comprises a spring element 15 formed mechanically or as a mechanical spring, which can be supported or is supported on one side at least indirectly, in particular directly, on the switching element 14 and on the other side at least indirectly, in particular directly, on the switching element 12. Here, the spring element 15 is received at least partially, in particular at least extensively or completely, in the switching element 14. By moving the switching element 12 out of the locking position into the unlocking position, the spring element 15 is tensioned, such that the spring element 15 is tensioned more greatly in the unlocking position than in the locking position. Thus, the spring element 15 in the unlocking position provides a spring force by means of which the switching element 12 can be moved or is moved out of the unlocking position into the locking position. The switching element 12 can thus be moved out of the locking position into the unlocking position in opposition to the spring element 15 or in opposition to the spring force provided by the spring element 15.

The switching element 12 and 14 are components formed separately from each other. Here, the coupling device 11 moreover comprises a housing 16 formed, for example, as a sleeve, which is formed separately to the outlet tilting lever 6 and separately from the switching elements 12 and 14. Moreover, the switching elements 12 and 14 are formed separately from the outlet tilting lever 6. Here, the housing 16 is received at least partially in a receiver 17 of the outlet tilting lever 6 formed, for example, as a passage opening. Here, the coupling device 11 is held on the outlet tilting lever 6 via the housing 16, for example. Here, the housing 16 has a male thread 18 and is screwed into a correspondingly formed female thread 19 of the receiver 17 of the outlet tilting lever 6. The coupling device 11 comprises a nut 20 formed separately from the housing 16 and separately from the outlet tilting lever 6, which nut also has a female thread 19 corresponding to the male thread 18. The male thread 18 is screwed to the female thread 19, whereby the housing 16 is secured via the nut 20 in the movement direction on the outlet tilting lever 6 against distorting in relation to the outlet tilting lever 6. To do so, the nut 20 can be supported or is supported on the outlet tilting lever 6 on the housing 16. If the housing 16 is rotated in relation to the outlet tilting lever 6, this results in a movement of the housing 16 and the switching elements 12 and 14 taking place in relation to the outlet tilting lever 6 in the movement direction. Thus, a clearance, also referred to as a valve clearance, in particular between the coupling device 11 and the valve bridge 10 is set.

The valve bridge 10 can be actuated by the coupling device 11 via a joint 21 formed, for example as a ball joint, and thus by the outlet tilting lever 6 via the joint 21 and the coupling device 11 and can thus be moved out of the second starting position into the second actuation position. The joint 21 presently comprises a ball socket formed by a ball cap 22 of the joint 21 and a joint head 23 formed, for example, as a ball joint head, the joint head engage in the ball cap 22. Thus, the ball cap 22 is flexibly connected to the joint head 23 formed as a ball head in the manner of a ball joint, such that the ball cap 22 can be pivoted in relation to the joint head 23 and, in particular, in relation to the switching elements 12 and 14 in the manner of a ball joint. For example, the ball cap 22 can be supported on the valve bridge 10, such that the valve bridge 10 can be actuated by the outlet tilting lever 6 via the joint 21 and the coupling device 11. Presently, the joint head 23 is provided on the switching element 14. In particular, the joint head 23 is formed by the switching element 14. Furthermore, it can be provided that the joint head 23 and the switching element 14 are formed integrally with each other.

As can be seen from FIG. 4 in the example of the gas exchange valve 3, the gas exchange valve 3 has a valve cap 24, via which the gas exchange valve 3 can be actuated by the valve bridge 10. In other words, if the valve bridge 10 is moved out of the second starting position into the second actuation position, then the gas exchange valve 3 is thus actuated via the valve cap 24, i.e., the valve cap 24 and, with this, the gas exchange valve 3 are actuated, i.e., moved. The gas exchange valve 2, in contrast, is supported directly on the valve bridge 10. Furthermore, the coupling device 11 comprises at least one form-fit element 25. In particular, the coupling device 11 can have several form-fit elements 25. The form-fit element 25 is formed, for example, as a ball, as a barrel or as a roller, such that the form-fit element 25 can be formed spherically or cylindrically on the side of the outer periphery. The form-fit element 25 can be moved in a direction running obliquely or perpendicularly to the movement direction (double arrow 13) and illustrated in FIG. 4 by a double arrow 26 in relation to the outlet tilting lever 6 and in relation to the housing 16 and in relation to the switching elements 12 and 14. The housing 16 has a first recess 27, in particular per each form-fit element 25, in which recess the form-fit element can engage. Thus, the form-fit element 25 can interact in a form-fit manner with the housing 16 and, via this, with the outlet tilting lever 6. This is carried out, in particular, by the housing 16 being fixed on the outlet tilting lever 6 in the movement direction illustrated by the double arrow 13 and in the direction illustrated by the double arrow 26 or being unmoveable in relation to the outlet tilting lever 6. The respective first recess is labelled in FIG. 4 with 27, for example, and is provided or fixed on the outlet tilting lever 6 via the housing 16, in particular.

In particular for each form-fit element 25, the switching element 14 has a second recess 28, which is formed, for example, as a passage opening. In particular for each form-fit element 25, the switching element 12 has a third recess 29. A support region 30 of the switching element 12 is attached to the third recess 29 in the movement direction towards the valve bridge 10. If the switching element 12 is in its locking position, then the form-fit element 25 is supported on the support region 30 of the switching element 12. Thus, the form-fit element 25 is held in a first position in which the form-fit element 25 simultaneously engages in the first recess 27 and the second recess 28. In doing so, the form-fit element 25 interacts in a form-fit manner with both the switching element 14 and with the housing 16 or with the outlet tilting lever 6. Thus, the coupling device 11 is locked, i.e., in doing so, the coupling device 11 is in its locking state. The locking state can be seen particularly well in FIG. 4. Since the switching element, for example, is held in the locking position by means of the spring element 15, the form-fit element 25 is held in the first position by means of the spring element 15 using the switching element 12. Since in the first position the form-fit element 25 interacts in a form-fit manner with both the switching element 14 and with the housing 16 or the outlet tilting lever 6, the switching element 14 is thus secured against translational movements taking place in the movement direction in relation to the outlet tilting lever 6 or in relation to the housing 16. In other words, translation movements of the switching element 14 taking place in the movement direction in relation to the outlet tilting lever 6 stop.

In the first position, the form-fit element 25 is at least partially, in particular at least extensively or completely, covered by or overlaps with, the support region 30 in the swerving direction that coincides with the direction illustrated by the double arrow 26 and points to the switching element 12, and here the form-fit element is supported on the support region 30, whereby the switching element 12 prevents the form-fit element 25 from being moved in the direction illustrated with the double arrow 26 and thus into the switching element 14 and being able to move away from the outlet tilting lever 6 or from the housing 16 and move out of the first recess 27.

If the switching element 12 is moved out of the locking position into the unlocking position in relation to the outlet tilting lever 6 and, here, in relation to the switching element 14 and in relation to the housing 16, in particular translationally, in the movement direction, whereby the spring element 15 is tensioned, then the recess 29 of the switching element 12 comes into such overlap or covering with the form-fit element 25 that the form-fit element 25 is then covered or overlapped by the third recess 29 in the direction illustrated with the double arrow 26. As a result, the form-fit element 25 is then moved in the direction 26 out of the first position, which can be seen in FIG. 4, into a second position that can be seen in FIGS. 8 and 12. In the second position, the form-fit element 25 is arranged in the third recess 29 in the switching element 12 and in the second recess 28 or through opening in the switching element 14, however in the second position the form-fit element 25 no longer engages in the first recess 27 in the housing 16. Thus, the form-fit element 25 interacts in a form-fit manner with the switching element 12 and with the switching element 14, yet the form-fit element 25 no longer interacts with the outlet tilting lever 6 or with the housing 16 in a form-fit manner. In other words, if the switching element 12 is moved out of the locking position into the unlocking position, then the form-fit element 25 is thus moved out of the first position into the second position. Thus, the switching element 12 releases the switching element 14 for an in particular translational movement taking place in the movement direction 26 in relation to the tilting outlet lever 6. Overall, it can be seen that the coupling device 11 is locked in the first position, such that the coupling device 11 is in the first position of the form-fit element 25 in the locking state (FIG. 4). In the second position of the form-fit element 25, the coupling device 11 is unlocked, such that the coupling device 11 is in the second position of the form-fit element 25 in the unlocking state (FIGS. 8 and 12). If the outlet tilting lever 6 is now moved or pivoted out of the first starting position into the first actuation position while the coupling device 11 is locked, then the outlet tilting lever 6 carries along the switching element 14, in particular via the housing 16. This means that the switching element 14 is also pivoted by means of the outlet tilting lever 6 around the pivoting axis 9, in particular out of the first starting position into the first actuation position, whereby the valve bridge 10 and, via this, the gas exchange valves 2 and 3 are actuated, in particular in opposition to the valve springs 4 and 5. However, if the outlet tilting lever 6 is moved or pivoted out of the first starting position into the first actuation position while the coupling device 11 is in its unlocking position, i.e., while the coupling device 11 is unlocked, then the outlet tilting lever 6 is pivoted around the pivoting axis 9 in relation to the switching element 14. In other words, the outlet tilting lever 6 then does not carry along the switching element 14, since the switching element 14, for example, is held via the valve bridge 10 in its in particular first starting position by means of the valve springs 4 and 5 (FIG. 12).

Figure 2:
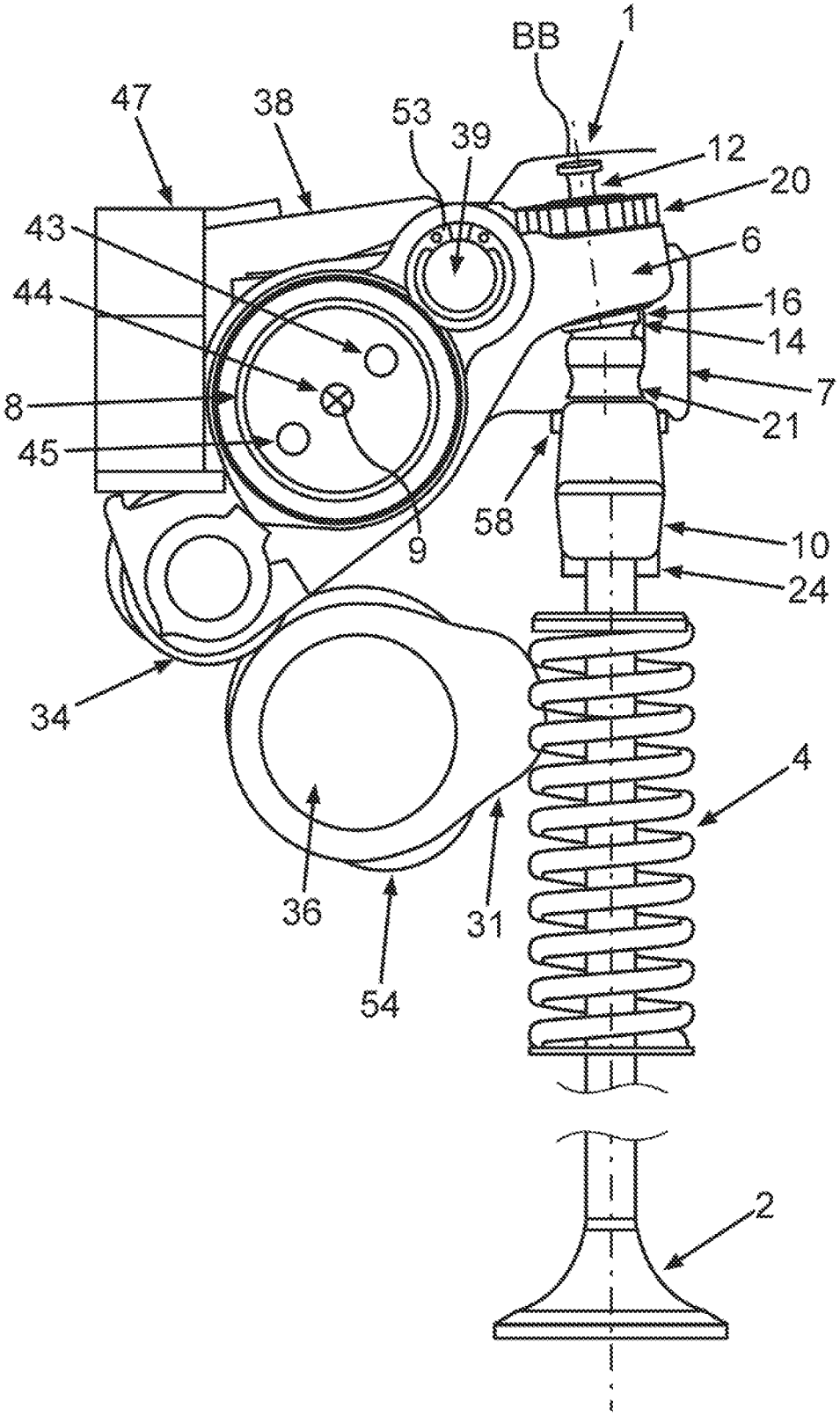
FIG. 2 is a schematic lateral view of the valve actuation device, wherein a coupling device of the valve actuation device is in its locking position.
Figure 3:
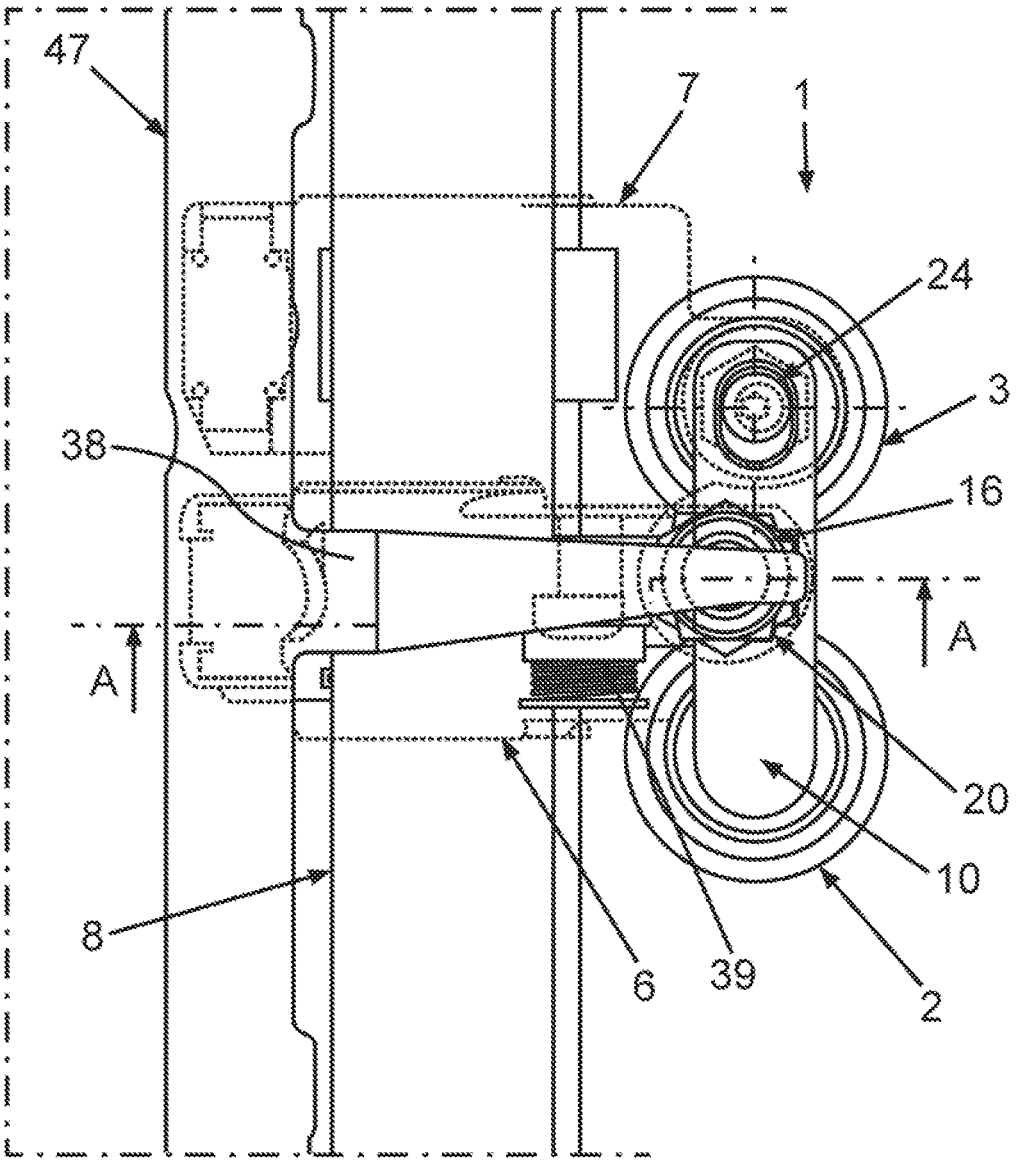
FIG. 3 is a schematic top view of the valve actuation device with transparently depicted tilting levers according to FIG. 2.

It can be seen particularly well in FIGS. 2 and 4 that the outlet tilting lever 6 can be actuated by means of a cam 31, also referred to as an outlet cam, i.e., can be pivoted out of the first starting position into the first actuation position. To do so, the cam 31 has a base circular region 32 and a cam elevation 33 also simply referred to as an elevation. The cam elevation 33 is raised in comparison to the base circular region 32 and is thus formed as a protrusion. Furthermore, a roller 34 is rotatably mounted on the outlet tilting lever 6. The cam 31 can be rotated along with a cam shaft and, here, can be rotated around a rotational axis 35 in relation to the housing of the internal combustion engine. The cam shaft can be seen, for example, from FIGS. 1 and 2 and is labelled there with 36. For example, the cam 31 is formed separately from the cam shaft 36, is arranged on the cam shafts 36 and is connected non-rotationally to the cam shaft 36. The roller 34 can be rotated around a rotational axis 37 in relation to the outlet tilting lever 6, wherein the rotational axes 35 and 37 run in parallel to each other and are spaced apart from each other. Moreover, the pivoting axis 9 is spaced apart from the rotational axes 35 and 37, wherein the pivoting axis 9 runs in parallel to the rotational axes 35 and 37. A first angular region or a first period of time during which the roller 34 proceeds on the base circular region 32 of the cam 31, is also referred to as the base circular phase. During the base circular phase, an actuation of the outlet tilting lever 6 caused by the cam 31 stops, such that the outlet tilting lever 6 is in its first starting position during the base circular phase. A second period of time or a second angular region or a second period of time during which the roller 34 rolls on the cam elevation 33 is also referred to as the actuation phase, wherein the outlet tilting lever 6 is actuated during the actuation phase by means of the cam 31 and is thus pivoted around the pivoting axis 9 or is held pivoted.

By the coupling device 11 now being held on the outlet tilting lever 6 and thus also being able to be pivoted around the pivoting axis 9 with the outlet tilting axis 6, a switching of the coupling device 11 between the locking state and the unlocking state can be linked precisely and in a defined manner with the pivoting of the outlet tilting lever 6 around the pivoting axis 9, in particular in such a way that the coupling device 11 is switched, in particular exclusively, by pivoting the outlet tilting ever 6 around the pivoting axis 9. Thus, it can be ensured that the coupling device 11 is switched during the base circular phase and not during the actuation phase, such that half switches of the coupling device 11 and resulting excessive loads of the valve actuation device 1 can be safely avoided.

Here, the valve actuation device 1 comprises an actuation element 38, which is formed as a mechanical spring, i.e., as a mechanical spring element, in the exemplary embodiment shown in the figures. The outlet tilting lever 6 and, with this, the coupling device 11 and thus the switching element 12 can be pivoted around the pivoting axis 9 in relation to the actuation element 38. By pivoting the outlet tilting lever 6 and the switching element 12 out of the first actuation position into the first starting position, the switching element 12 can be moved out of the locking position into the unlocking position by means of the actuation element. Moreover, by pivoting the outlet tilting lever 6 out of the first actuation position into the first starting position, the actuation element 38 can be moved out of an active position that can be seen in FIG. 6, for example, into a withdrawal position that can be seen in FIG. 4, for example. In the active position, by pivoting the outlet tilting lever 6 and the switching element 21 out of the first actuation position into the first starting position, the switching element 12 can be moved out of the locking position into the unlocking position by means of the actuation element 38. In the withdrawal position of the actuation element 38, despite the outlet tilting lever 6 and the switching element 12 pivoting out of the first actuation position into the first starting position, a movement of the switching element 12, caused by means of the actuation element, out of the locking position into the unlocking position stops.

To do so, the valve actuation device 1 has a movement element 39 provided in addition to the coupling device 11. The movement element 39 is formed as a piston and can be held on the outlet tilting lever 6 and thus also pivoted with the outlet tilting lever 6 around the pivoting axis 9. Here, the piston 39 can be moved, in particular translationally, in a switching direction illustrated in FIG. 5 by a double arrow 40 in relation to the outlet tilting lever 6 and in relation to the coupling device 11, in particular in relation to the switching element 12 and 14, between at least one movement position that can be seen from FIG. 5 and at least one rest position that can be seen from FIG. 9 and FIG. 13. Here, the piston 39 is received at least partially in the outlet tilting lever 6. If the piston 39 is in its movement position while the outlet tilting lever 6 and, with this, the switching element 12, are moved or pivoted out of the first actuation position into the first starting position, then the actuation element 38 is moved out of the active position into the withdrawal position by means of the piston 39, in particular raised. To do so, the piston 39 has a shell surface 41 on the outer peripheral side, which comes into supported abutment with the actuation element 38, in particular with a lug 42 (FIGS. 4 and 5) of the actuation element 38 when the outlet tilting lever 6 is pivoted out of the first actuation position into the first starting position when the tilting outlet lever 6 and the piston 39 is in its movement position. Here, the lug 42 protrudes beyond areas of the actuating element 38 adjoining the lug 42 on both sides towards the piston 39. The movement of the actuation element 38 that can be caused or is caused by the piston 39 out of the active position into the withdrawal position prevents the switching element 12 coming into supported abutment with the actuation element 38. In doing so, the switching element 12 is prevented from moving into the unlocking position by means of the actuation element 38. Thus, the switching element 12 remains in the locking position, such that the coupling device 11 remains locked.

Figure 13:
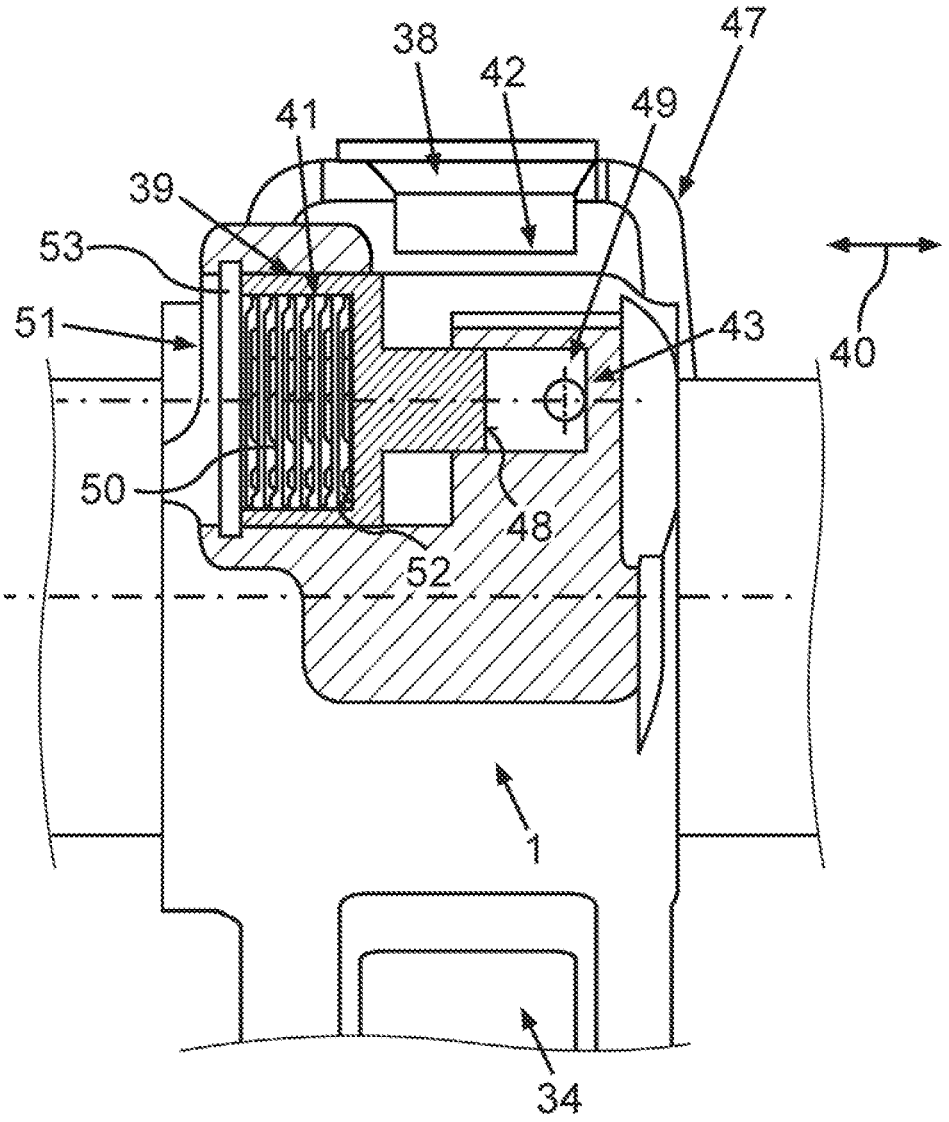
FIG. 13 is a schematic sectional view of the first tilting lever of the valve actuation device along a sectional line F-F shown in FIG. 12.

However, if the outlet tilting lever 6 is moved out of the first actuation position into the first outlet position while the piston 39 is in the rest position, then the shell surface 41 or the piston 39 on the outer peripheral side does not come into supported abutment with the actuation element 38 (FIGS. 12 and 13). In doing so, the actuation element 38 is not moved out of the active position into the withdrawal position, but the actuation element 38 remains in the active position. As a result, the switching element 12 is moved by means of the actuation element 38, in particular with an actuation region BB (FIG. 8 and FIG. 12) of the actuation element 38. In doing so, the switching element 12 is moved out of the locking position into the unlocking position by means of the actuation element 38, in particular via the actuation region BB. Thus, the coupling device 11 is unlocked. If then, or during a subsequent working cycle, the exhaust rocker arm 6 is pivoted again by means of the cam 31 and thus moved from the first starting position to the first actuating position, the fact that the coupling device 11 is unlocked or was previously unlocked means that the valve bridge 10 is not actuated, that is not moved from the second starting position to the second operating position (FIG. 12). As a result, the gas exchange valves 2 and 3 are not activated. Then if the outlet tilting lever 6 returns to its first starting position while the piston 39 is still in the rest position, then a lock of the coupling device 11 stops. This means that the coupling device 11 remains unlocked, such that even when the outlet tilting lever 6 is then pivoted into the first actuation position the valve bridge 10 is not actuated. Only when the outlet tilting lever 6 is moved out of the first actuation position into the first starting position is the valve bridge 10 not actuated, while the piston 39 is in the active position, the coupling device 11 is locked again, since the switching element 12 can then move back into the locking position in relation to the switching element 14.

It can be seen particularly well from FIG. 12 that, when the coupling device 11 is unlocked and the outlet tilting lever 6 is pivoted out of the first starting position into the first actuation position, the outlet tilting lever 6 does not carry along the switching elements 12 and 14, but the switching elements 12 and 14 remain in their respective starting position, for example corresponding to the first starting position. Only when the coupling device 11 is locked does the outlet tilting lever 6 carry along the switching elements 12 and 14, whereby the valve bridge 10 is then actuated via the switching element 14.

It can be seen particularly well from FIGS. 2 and 4 that the outlet tilting lever 8 has channels 43, 44 and 45, which can be flowed through by a fluid, in particular a liquid. The liquid is preferably an oil. The outlet tilting ever (first tilting lever 6) can be supplied with oil via the channel 43. The braking tilting lever (second tilting ever 7) can be supplied with oil via the channel 44. The roller 34 can be supplied with oil via the channel 45. The roller 43 is also referred to as a cam filter by means of which the outlet tilting lever 6 can be actuate by the cam 31.

A mechanical spring element in the form of a first tilting lever spring 46 is allocated to the roller 34 (cam follower), by means of which the roller 34 is held or can be held in supported abutment with the cam 31. To do so, the tilting lever spring 46 is supported, on one side, at least indirectly, in particular directly, on the outlet tilting lever 6 in the region of the roller 34 and, on the other side, at least indirectly, in particular directly, on a spring bracket 47. The actuation element 38 is held on the spring bracket 47 and is arranged, for example, between the tilting lever spring 46 and the spring bracket 47, and here can be supported or is supported in particular on the spring bracket 46 in a direction indicated by the outlet tilting lever 6. If the actuation element 38 is moved out of the active position into the withdrawal position, for example, by means of the piston 39 in the movement position, then the actuation element 38 is thus deformed elastically. If the outlet tilting lever 6 and, with this, the piston 39 are then moved or pivoted out of the first starting position into the first actuation position, then the actuation element 38, which is elastically deformed in the withdrawal position and thus in the first starting position, can spring back elastically and thus elastically return to the active position, in particular independently or automatically. The actuation element 38 remains in the active position when the outlet tilting lever 6 is pivoted out of the first actuation position into the first starting position, and the piston is here in the rest position. In order to here move the switching element 12, for example, by means of the actuation element 38 out of the locking position into the unlocking position, then the actuation element 38 is supported or can be supported on the spring bracket 47. The spring element 15 or the spring force that is provided or can be provided by means of the spring element 15 is not sufficient in order move the actuation element 38 initially in the active position out of the active position into the withdrawal position when the outlet tilting lever 6 and, with this, the coupling device 11 are pivoted out of the first actuation position into the first starting position, but rather the switching element 12 is moved out of the locking position into the unlocking position by means of the actuation element 38.

Figure 5:
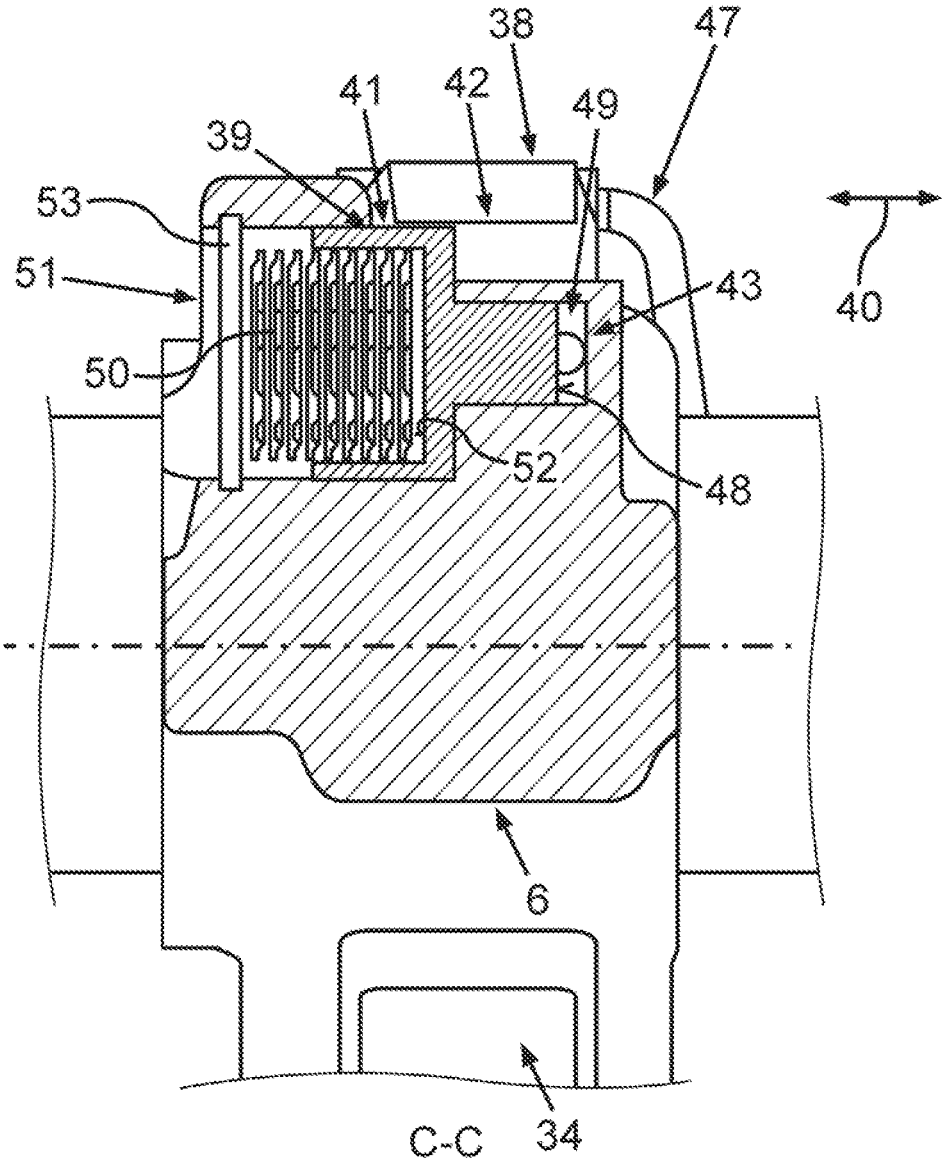
FIG. 5 is a schematic sectional view of a first tilting lever of the valve actuation device along a cutting line C-C shown in FIG. 4.
Figure 6:
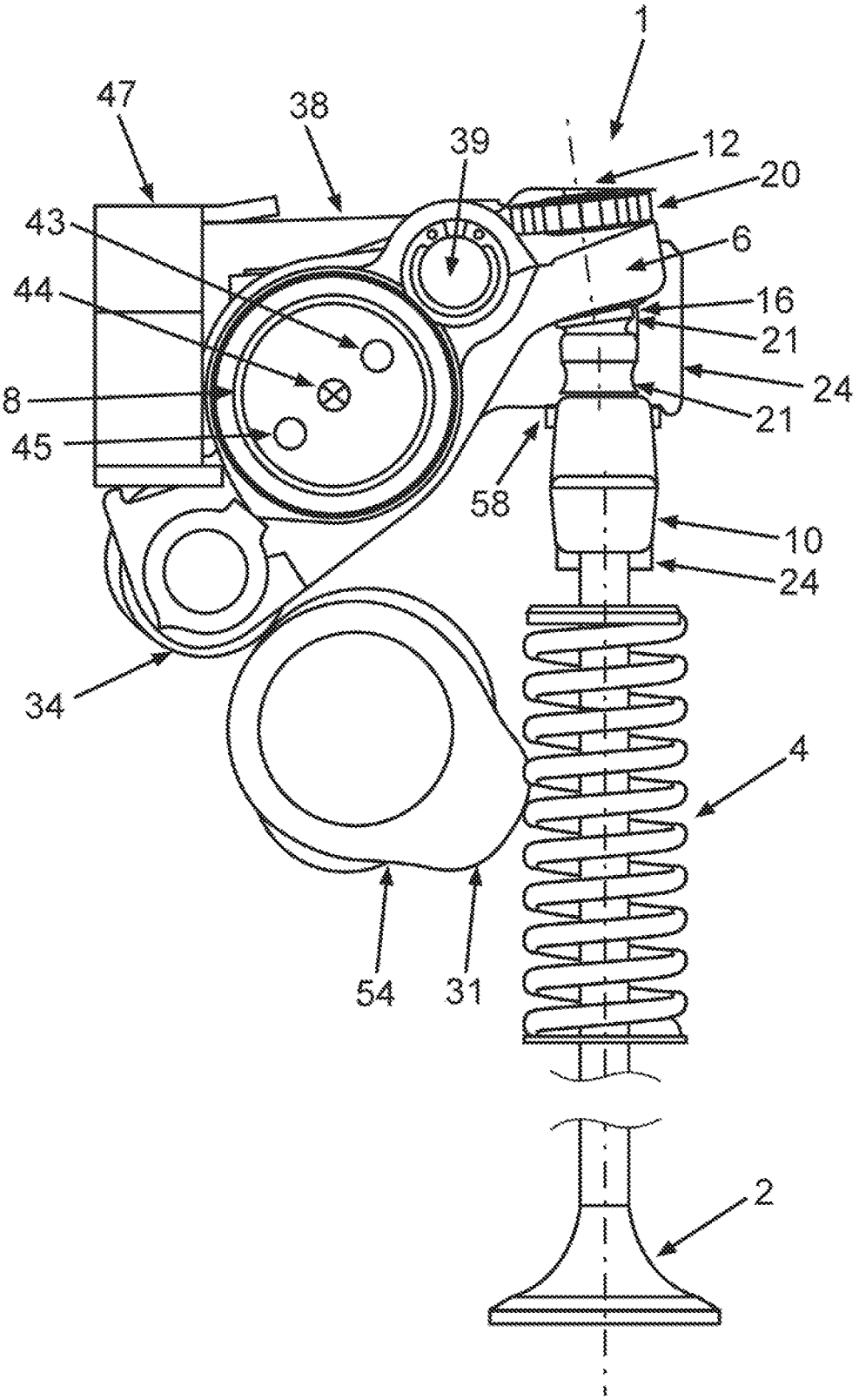
FIG. 6 is a schematic lateral view of the valve actuation device, the coupling device of which is in its unlocking state.
Figure 7:
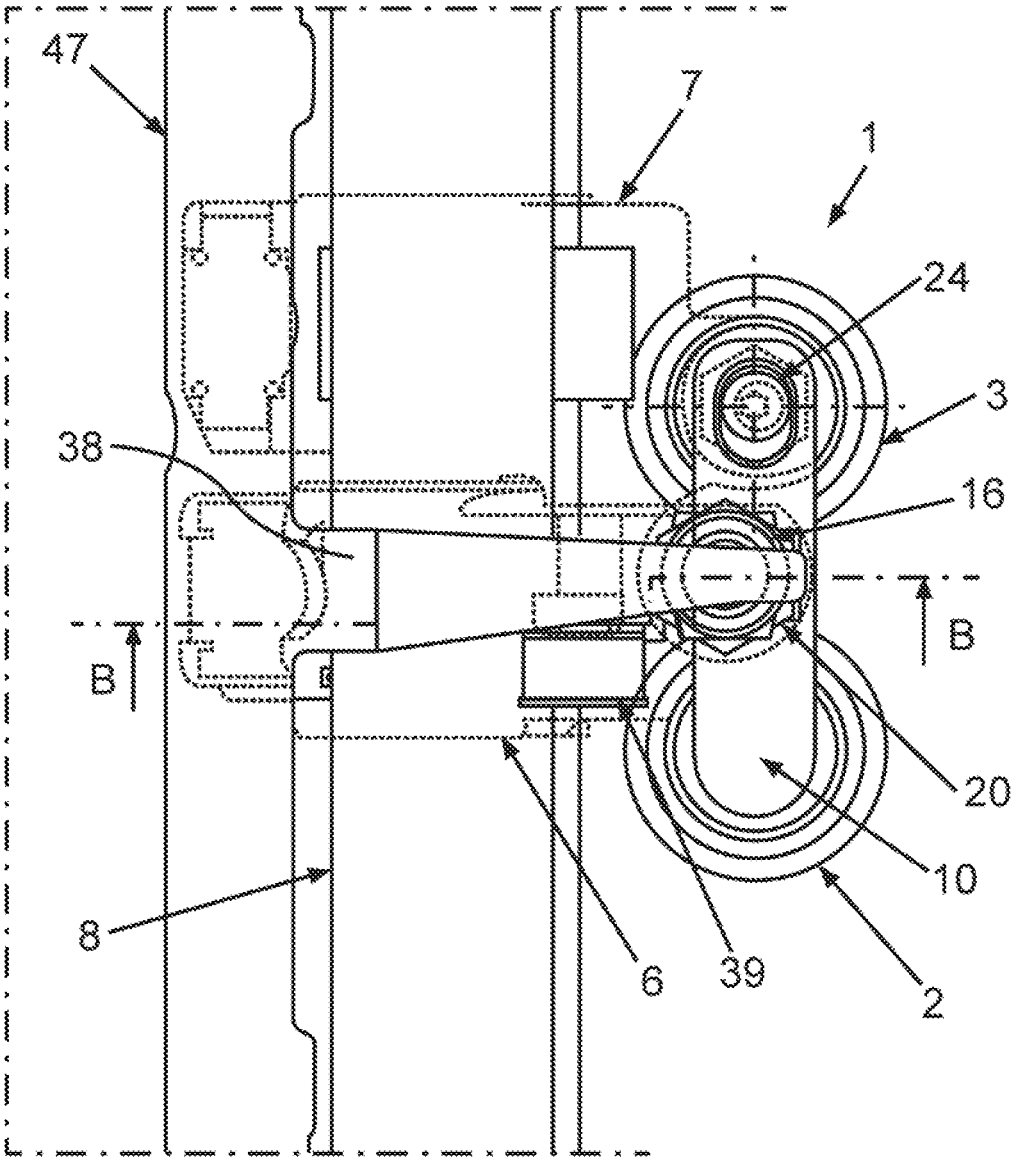
FIG. 7 is a schematic top view of the valve actuation device with transparently depicted tilting levers according to FIG. 6.
Figure 9:
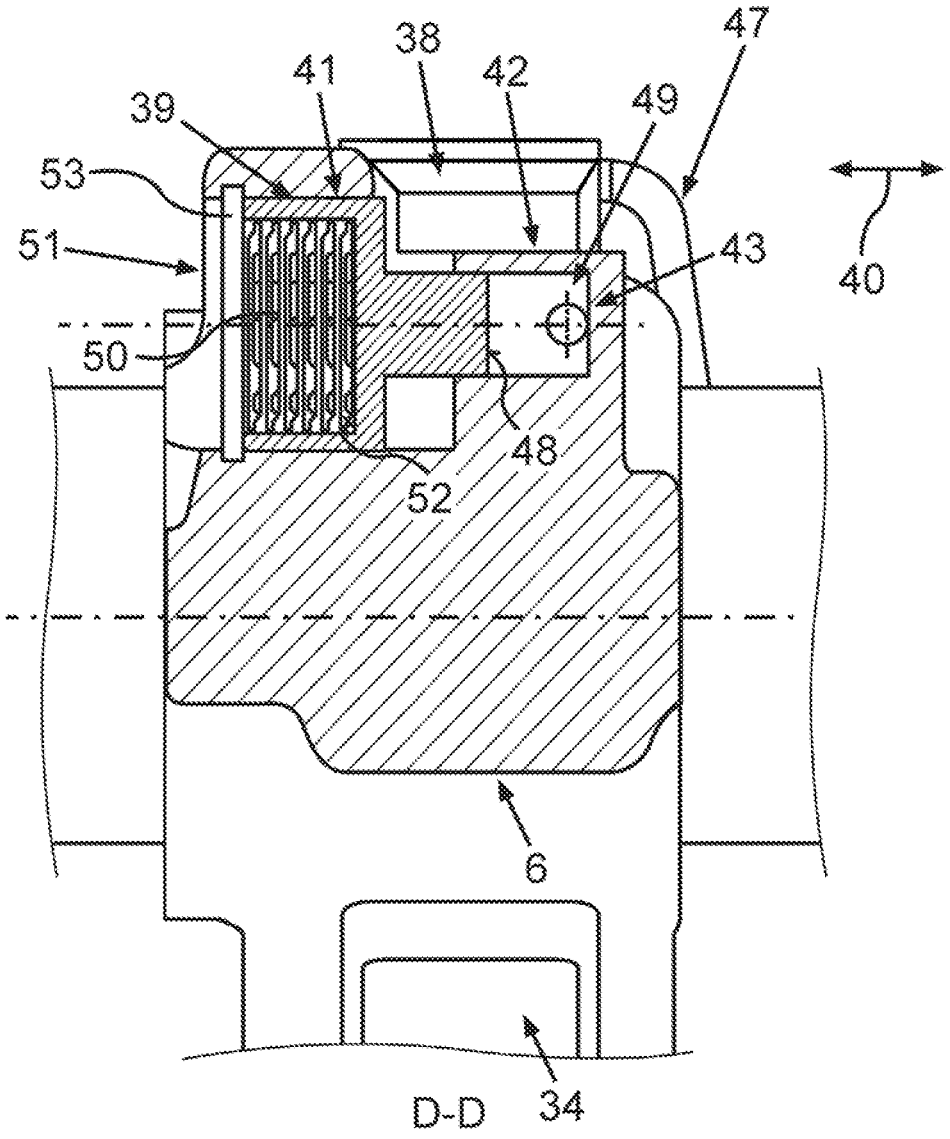
FIG. 9 is a schematic sectional view of the first tilting lever of the valve actuation device along a sectional line D-D shown in FIG. 8.

It can be seen from FIG. 5 that the outlet tilting lever 6 and the piston 39, in particular an end face 48 of the piston 39, delimit a working chamber 49 also referred to simply as a chamber. If the piston 39 is moved out of the movement position shown in FIG. 5 into the rest position, in particular shifted, then a volume enlargement or volume increase of the working chamber 49 also occurs. If the piston 39 is moved out of the rest position into the movement position, then a volume decrease or volume reduction of the working chamber 49 thus occurs. In particular, it can be seen from FIG. 5 that the channel 43 opens out into the working chamber 49. In other words, the oil flowing through the channel 43 can be led or supplied to the working chamber 49 by means of the channel 43. By introducing the oil into the working chamber 49, a volume increase of the working chamber 49 is caused, whereby the piston 39 is caused out of the movement position into the rest position in relation to the outlet tilting lever 6 (FIG. 9 and FIG. 13). Thus, the piston 39 can be moved hydraulically out of the movement position into the rest position, in particular can be shifted, such that the coupling device 11 can be unlocked specifically and as needed.

Moreover, the valve actuation device 1 comprises a spring element 50 formed as a mechanical spring, which is arranged on a side 51 of the piston 39 facing away from the working chamber 49, in particular in the switching direction illustrated by the double arrow 40. The spring element 50 can be supported or is supported in the switching direction on one side at least indirectly, in particular directly, on the piston 39, in particular on a further end face 52 of the piston. Here, the end face 52 is facing away, in particular in the switching direction. On the other side, the spring element 52 can be supported or is supported at least indirectly, in particular directly, on the outlet tilting lever 6. Presently, the spring element 50 can be supported or is supported on the other side via a plate or a safety ring 53 on the outlet tilting lever 6.

If the piston 39 is moved out of the movement position into the rest position in relation to the outlet tilting lever 6, then the spring element 50 is thus tensioned. The spring element 50 is thus tensioned more greatly in the rest position of the piston 39 than in the movement position, such that the spring element 50 provides a spring force at least in the rest position. The piston 39 can be moved or is moved out of the rest position into the movement position by means of this spring force provided by the spring element 50 in the rest position. In other words, by means of the oil introduced into the working chamber 40, the piston 39 is moved out of the movement position into the rest position in opposition to the spring force of the spring element 50 and, in particular, is held in the rest position. For example, by discharging the oil out of the working chamber 49 or by an outflow of the oil initially received in the working chamber 40 from the working chamber 40 being permitted, the spring element 50 can be at least partially relaxed. In doing so, the piston 39 is moved out of the rest position into the movement position by means of the spring force of the spring element 50 or by means of the spring element 50.

Figure 14:
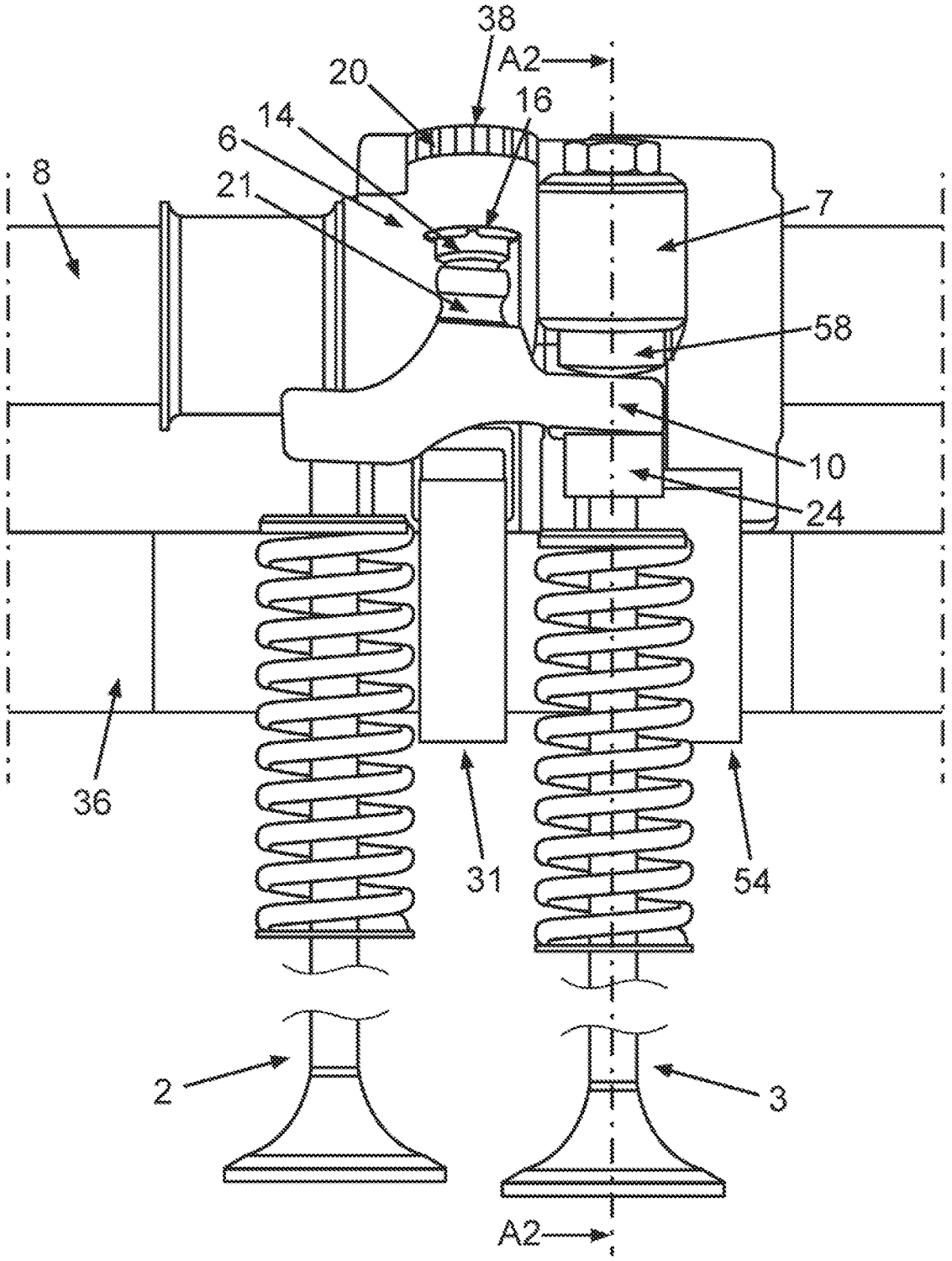
FIG. 14 is a schematic front view of the valve actuation device, the coupling device of which is in the unlocking state.

The braking tilting lever (second tilting lever 7) and, in particular, its function can be seen particularly well from FIGS. 14, 15, 16 and 17. A further cam 54 in addition to the cam 31 is allocated to the braking tilting lever 7, the cam being formed separately from the camshaft 36, being arranged on the cam shaft 36 and being non-rotationally connected to the camshaft 36. A further cam follower presently formed as a further roller 55 is also allocated to the braking tilting lever 7, wherein the roller 55 is rotatably held on the braking tilting lever 7. The roller 55 can unwind on the cam 54. Here, a further mechanical spring element, presently in the form of a tilting lever spring 56, is allocated to the roller 55, by means of which spring element the roller 55 is held in supportive abutment with the cam 54. The cam 54 also has, for example, at least one base circular region not referred to in more detail and at least one or more cam elevations, which are raised in relation to the base circular region of the cam 54. In the base circular region or when the roller 55 unwinds on the base circular region, a pivoting of the braking tilting ever 7 around the tilting lever axis 8 stops. However, if the roller 55 interacts with the respective cam elevation of the cam 54, then the braking tilting lever 7 is pivoted and thus actuated in relation to the tilting lever axis 8, in particular around the pivoting axis 9. The valve actuation device 1 here comprises a second coupling device 57, via which the gas exchange valve 3 can be actuated by the braking tilting lever (second tilting lever 7), in particular during a movement of the valve bridge 10 out of the second starting position into the second actuation position and thus an actuation of the gas exchange valve 2 stops. This means that, in relation to the gas exchange valves 2 and 3, exclusively the gas exchange valve 3 can be actuated by the braking tilting lever 7 via the coupling device 57 and can thus be moved out of the closed position into the open position (FIG. 14). Here, the cam 54, in particular its cam elevation or cam elevations, is or are preferably designed or formed in such a way that the gas exchange valve 3 is opened within the respective work cycle, for example in the region of the upper ignition dead centre (ZOT), in particular when the coupling device 11 is unlocked. In doing so, an engine brake formed as a decompression brake can be implemented. As is well-known from the prior art, when the engine brake, formed as a decompression brake, is activated, gas in the combustion chamber is compressed by means of the piston in such a way that the piston is moved out of its lower dead centre into its upper dead centre (ZOT). In the upper dead centre or in the region of the upper dead centre, the gas exchange valve 3 is opened by means of the braking tilting lever 7, such that energy contained in the compressed gas, in particular compression energy, is not used to drive the piston and thus not to drive the output shaft in a subsequent stroke, during which the piston is moved out of its upper dead centre into its lower dead centre, but instead is lost when it is substantially unused. Thus, the internal combustion engine has to work to compress the gas, but energy contained in the compressed gas is at least partially, in particular at least extensively or completely, not user to drive the output shaft, such that the motor vehicle is decelerated or is kept at least substantially constant in terms of its speed. In this way, an excessive speed increase of the motor vehicle can be effectively and efficiently avoided by means of the engine brake. Preferably, the engine brake is deactivated, while the coupling device 11 is locked. Alternatively or additionally, the engine brake is activated when the coupling device 11 is unlocked.

The coupling device 57 is provided to activate and deactivate the engine brake. Here, as is known from the prior art and here from EP 2 425 105 B1, for example, the coupling device 57 comprises a piston 58 also referred to as a hydraulic piston, which can be moved and thus can be shifted translationally in a direction illustrated by a double arrow 59 in FIG. 16, for example, in relation to the braking tilting lever 7. The shifting direction runs on a plane, for example, which runs in parallel to a plane in which the movement direction illustrated by the double arrow 13 (FIG. 4) runs. Moreover, the coupling device 57 comprises an adjusting screw 60 and a nut 61 corresponding to it. The adjusting screw 60 has a male thread 62, wherein the nut 61 has a female thread 63 corresponding to the male thread 62. The female thread 63 is screwed to the external thread 62. The adjusting screw 60 is partially received in the piston 58 and has a collar 64, wherein a spring element 65 formed as a mechanical spring of the coupling device 57 is supported in the shifting direction on one side at least indirectly, in particular directly, on the collar 64. Moreover, the coupling device 57 comprises a further collar 66, which is formed separately from the adjusting screw 60 and separately from the piston 58. In the shifting direction, the further collar 66 is supported on one hand indirectly, in particular directly, on the adjusting screw 60, in particular on a flange 67 of the adjusting screw 60. On the other side, the further collar 66 is supported at least indirectly, in particular directly, in the shifting direction on the piston 58. Presently, the further collar 66 is supported using a securing ring 68 on the other side in the shifting direction on the piston 58. Here, the spring element 65 is supported in the shifting direction on the other side at least indirectly, in particular directly, on the further collar 66. The piston 58 and, with this, the further collar 66 can be shifted in the shifting direction fundamentally in relation to the adjusting screw 60.

Figure 16:
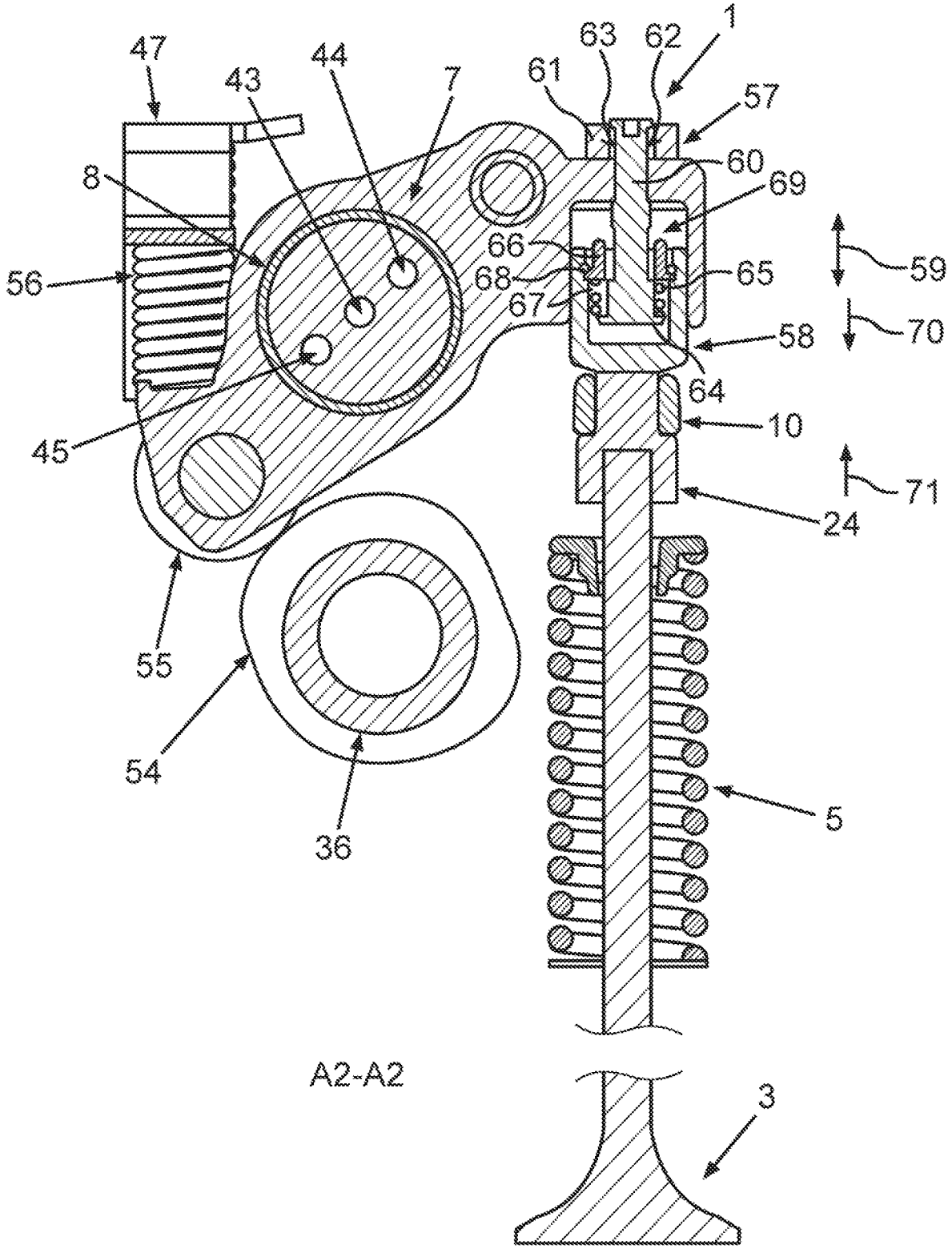
FIG. 16 is a schematic sectional view of the valve actuation device along a sectional line A2-A2 shown in FIG. 14.
Figure 17:
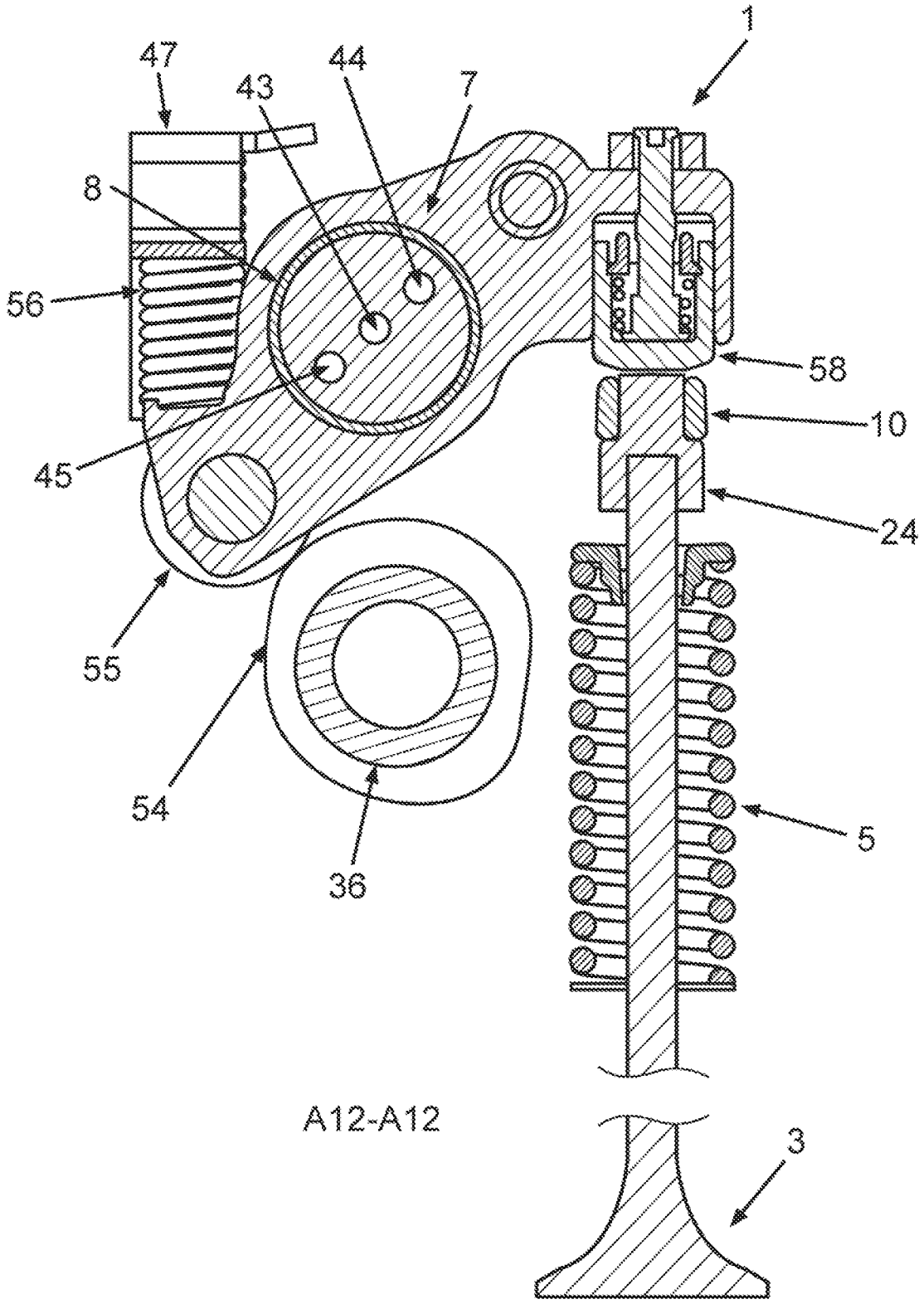
FIG. 17 is a schematic sectional view of the valve actuation device along a sectional line A12-A12 shown in FIG. 15.

Furthermore, it can be seen from FIGS. 16 and 17 that the piston 58 and the braking tilting lever 7 delimit a further second working chamber 69, also referred to as the second chamber. The working chamber 69 can be supplied with the oil via the channel 44. In other words, oil flowing through the channel 44 can be introduced into the working chamber 69. The piston 58 and, with this, the further collar 66 can now be shifted in the shifting direction in relation to the braking tilting lever 7 between at least one extended position that can be seen from FIG. 16 and at least one retracted position that can be seen from FIG. 17. In the extended position, the engine brake is activated, such that when the braking tilting lever 7 is actuated, in particular by means of the cam 54, and is thus pivoted while the piston 58 is in the extended position, the gas exchange valve 3 is actuated via the valve cap 24, while a movement of the valve bridge 10 out of the second starting position into the second actuation position stops. In addition, the valve cap 24 can be moveably received in the valve bridge 10 in the direction marked with the double arrow 59. The valve cap 24 is plugged on the outlet valve 3.

Figure 15:
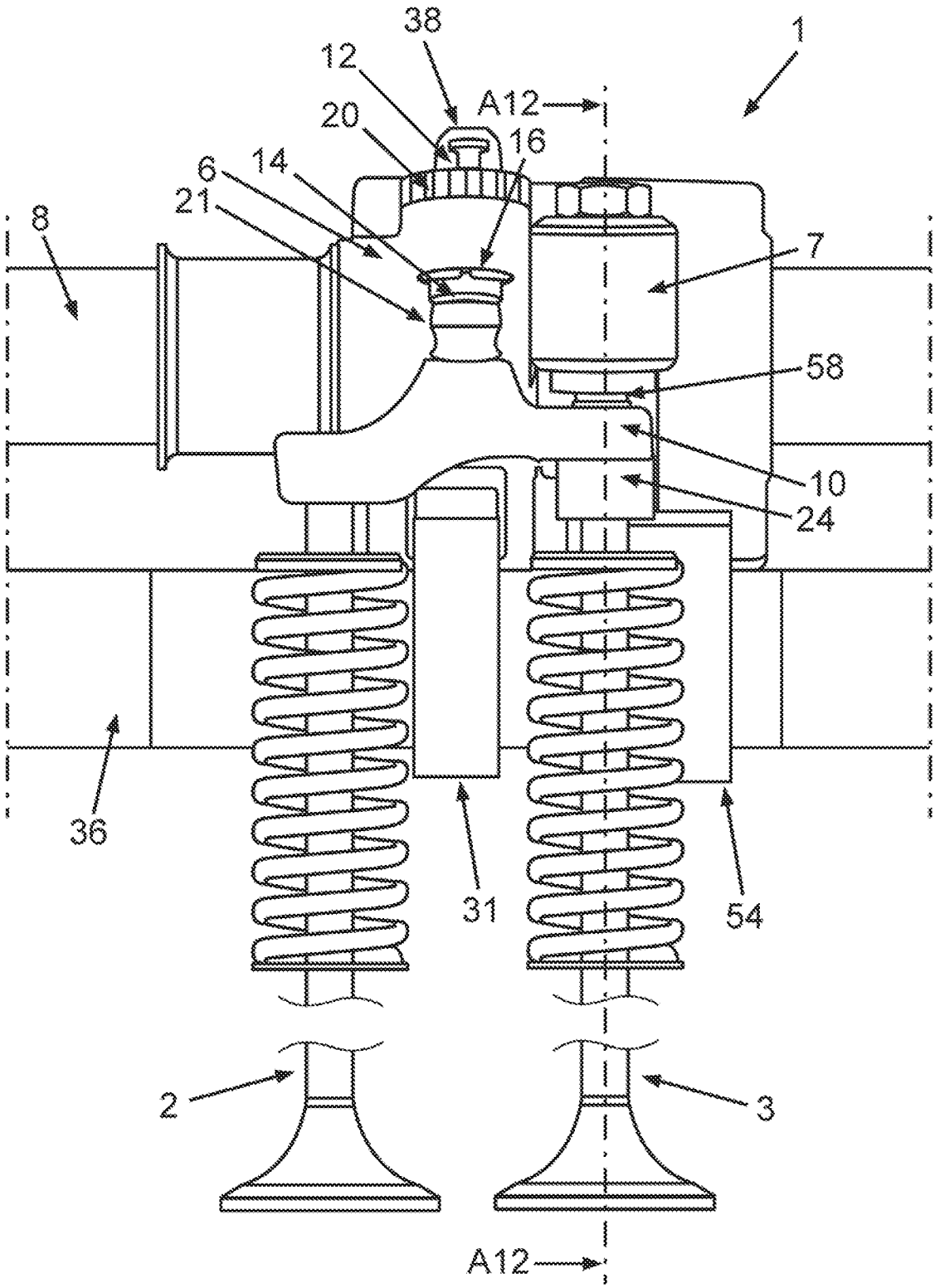
FIG. 15 is a schematic front view of the valve actuation device, the coupling device of which is in the locking state.

If, however, the braking tilting lever 7 is actuated, in particular by means of the cam 54, and is thus pivoted around the pivoting axis 9 in relation to the tilting lever axis 8 while the piston 58 is in the retracted position, i.e., while the engine brake is deactivated, then an actuation of the gas exchange valve 3 stops despite the braking tilting lever 7 pivoting or actuating. If the piston 58 is in the retracted position while the braking tilting lever 7 is actuated, i.e., pivoted, then the piston 58 also referred to as an actuation piston or actuator piston, does not come into contact, or only marginally, with the valve cap 24 in such a way that an actuation of the gas exchange valve 3 stops (FIG. 15). If the piston 58 is also in the extended position while the braking tilting lever 7 is actuated, then the piston 58 interacts in such a way, in particularly via the valve cap 24, with the gas exchange valve 3, i.e., for example the piston 58 comes into such at least indirect contact with the gas exchange valve 3, that the gas exchange valve 3 is actuated (FIG. 14).

If the piston 58 is initially in its retracted position, for example, then the piston 58 is moved out of the retracted position into the extended position in such a way that the oil is introduced into the working chamber 69 via the channel 44. Thus, the piston 58 and, with this, the further collar 66 are shifted in a extending direction coinciding with the shifting direction, illustrated in FIG. 16 by an arrow 70 and pointing away from the nut 61 in relation to the braking tilting lever 7 in such a way that the piston 58 is at least partially moved out of the braking tilting lever 7. In other words, a region of the piston 58 in the retracted position in the braking tilting lever 7 is thus moved out of the braking tilting lever 7. In doing so, the spring element 65 is tensioned between the collar 64 and the further collar 66, in particular compressed. Thus, the piston 58, for example, is shifted in opposition to the spring force provided by the spring element 65 out of the retracted position into the extended position and held in the extended position, for example. Furthermore, it can be seen that the spring element 65 is tensioned more greatly in the extended position than the retracted position, such that the spring element 65 provides a spring force, at least in the extended position. If the oil, for example, is dissipated from the working chamber 69 or if the oil initially in the working chamber 69 is allowed to flow out of the working chamber 69, the piston 58 is then moved, i.e., shifted, by means of the spring element 65, i.e., by means of the spring force provided by the spring element 65, out of the extended position back into the retracted position in relation to the brake tilting arm 7.

Overall, it can be seen that the outlet tilting lever (first tilting lever 6) includes the switching element 12 for switching off the respective stroke of the gas exchange valves 2 and 3, also referred to as an outlet stroke. In comparison to convention solutions, this allows a greater degree of freedom when designing the cam elevation of the cam 54, also referred to as the brake cam elevation, whereby in turn a particularly high braking performance, also referred to as engine braking performance, of the engine brake can be achieved. In particular, a so-called four-tact decompression brake can be implemented by means of the valve actuation device 1, which is also referred to as a four-tact engine braking system. The depiction of a two-tact engine braking system is also conceivable, which could, however, necessitate an additional switch of a valve train on the inlet side from a four-tact to a two-tact operation.

Overall, it can furthermore be seen that the switching element 12 is a hydraulic-mechanically actuated or actuatable and mechanically locked or lockable switching element, since firstly the piston 39 is hydraulically actuated to actuate or unlock the coupling device 11 and here is moved out of the movement position into the rest position. As a result, the switching element 12 is mechanically actuated by means of the actuation element 38 and, is here moved out of the locking position into the unlocking position, for example. Moreover, the form-fit element 25 enables a mechanical locking of the switching element 12 in the locking state of the coupling device 11 in the manner described. The special feature lies, in particular, in the fact that the stroke switch-off is carried out hydraulically or is caused hydraulically or initiated by the piston 39 being moved hydraulically, yet the actual switching trigger, i.e., the actual unlocking of the coupling device 11, is carried out mechanically or is controlled mechanically via the outlet tilting lever 6 and, in particular, its pivoting out of the first actuation position into the first starting position. In doing so, on one hand, a simply hydraulic switching actuation can be carried out. On the other hand, the switching process, i.e., switching the coupling device 11, is carried out by actuating the switching 12 via a deflection, i.e., via pivoting the outlet tilting lever 6 within or during the base circular phase of the cam 31 via pivoting the braking tilting lever (second tilting lever 7), such that the coupling device 11 is clearly and thus safely switched. In particular, it makes it possible to completely switch the valve actuation device 1, the switching element 12 within the base circular phase and thus to switch the coupling device 11 completely within the base circular phase, whereby half-switched states of the coupling device 11 and resulting excessive component loads can be avoided.

Furthermore, it can be seen that the piston 39 is spring loaded and is in the movement position in a spring-loaded manner. By means of a periodic movement, in particular by means of a periodic pivoting, of the outlet tilting lever (first tilting lever 6) from the base circular phase into the actuation phase, also referred to as the stroke phase, and back again into the base circular phase. The piston 39 also raises the actuation element 38 formed, for example, as a flat spring, periodically in the stroke phase, in particular at the end of it, via its shell surface 41 on the side of the outer periphery. The actuation element 38 is used to trigger the switching process, in particular for unlocking the coupling device 11, and in its raised position, i.e., in its withdrawal position, cannot press on the switching element 12 formed, for example, as a pin, and thus the switching element 12 cannot not move out of the locking position into the unlocking position and thus the coupling device 11 cannot unlock. Thus, the coupling device 11 remains in its locking state, and an outlet stroke is completely transferred from the cam 31 via the braking tilting lever 7, the coupling device 11 and the valve bridge 10 to the gas exchange valves 2 and 3. As a result, the gas exchange valves 2 and 3 are actuated, i.e., opened. In order to switch on the engine brake, i.e., in a switching process for switching on or activating the engine brake, a lacuna is led via a hydraulic circuit, which supplies the braking tilting lever 7 with oil and here comprises the channel 44, for example, also via the channel 44 to the piston 39 functioning as a switching piston and is here introduced into the working chamber 49 in particular. In doing so, the shifting of the piston 39 described above out of the movement position into the rest position is caused. As a result, the piston 39 with its shell surface 41 on the side of the outer periphery can no longer raise the actuation element 38 formed, for example, as a switching spring or functioning as a switching spring, i.e., can no longer move it out of the active position into the withdrawal position, whereby the actuation element 38 actuates the switching element 12 formed, for example, as a pin in a closing phase of the outlet tilting lever 6, i.e., when the outlet tilting lever 6 is moved back into its first starting position and, as a result, is moved out of the locking position into the unlocking position. In doing so, the coupling device 11 is unlocked, and in or from the next stroke phase, i.e., in a following work cycle, the stroke of the gas exchange valves 2 and 3 is absent. Moreover, the piston 58 formed or functioning as a hydraulic braking piston extends, in particular simultaneously, out of the braking tilting lever 7, whereby a braking stroke is transferred from the cam 54 functioning as a braking cam, via the braking tilting lever 7 and the coupling device 57, in particular the piston 58, and optionally the valve cap 24 to the gas exchange valve 3. As a result, the gas exchange valve 3 carries out the braking stroke, while an actuation of the gas exchange valve 2 or a movement of the valve bridge 10 out of the second starting position into the second actuation position stops. In order to switch off or when switching off the engine brake, a hydraulic pressure is now correspondingly lowered or raised in the working chamber 49 and preferably in the working chamber 69, such that the piston 39 is moved by means of the spring element 50 out of the rest position into the movement position, and such that the piston 58, for example, is moved, in particular shifted, by means of the spring element 65 out of the extended position into the retracted position in relation to the braking tilting lever 7. Here, the piston 58 is retracted into the braking tilting lever 7 in a retracting direction illustrated in FIG. 16 by an arrow 71 and in opposition to the extension direction (arrow 70) and here in the direction of the nut 61, for example.

As a result, the piston 39 with its shell surface 41 on the side of the outer periphery can raise the actuation element 38 again or move it out of the active position into the withdrawal position, such that the actuation element 38 no longer actuates the switching element 12 in a closed phase of the outlet tilting lever 6 and thus no longer moved it out of the locking position into the unlocking position. As a result, the switching element 12 is spring loaded, i.e., locks again by means of the spring element 15 or moves out of the unlocking position into the locking position, whereby the piston device 11 is locked. In a subsequent work cycle, the outlet stroke is carried out again by the gas exchange valves 2 and 3 during the next stroke phase, for example. Moreover, the piston 58 is spring loaded, in particular simultaneously, i.e., retracted again by means of the spring element 15, i.e., moves out of the extended position into the retracted position. The switching element 12 or the coupling device 11 in or on the outlet tilting lever 6 ends, in principle, on the roller seal, as can be used with or in guns.

LIST OF REFERENCE CHARACTERS

1 Valve actuation device
2 Gas exchange valve
3 Gas exchange valve
4 Valve spring
5 Valve spring
6 First tilting lever
7 Second tilting lever
8 Tilting lever axis
9 Pivoting axis
10 Valve bridge
11 Coupling device
12 Switching element
13 Double arrow
14 Switching element
15 Spring element
16 Housing
17 Receiver
18 Male thread
19 Female thread
20 Nut
21 Joint
22 Ball cap
23 Joint head
24 Valve cap
25 Form-fit element
26 Double arrow
27 First recess
28 Second recess
29 Third recess
30 Support region
31 Cam
32 Base circular region
33 Cam elevation
34 Roller
35 Rotational axis
36 Camshaft
37 Rotational axis
38 Actuation element
39 Movement element
40 Double arrow
41 Shell surface
42 Lug
43 Channel
44 Channel
45 Channel
46 Tilting lever spring
47 Spring bracket
48 End face
49 Working chamber
50 Spring element
51 Side
52 End face
53 Securing ring
54 Cam
55 Roller
56 Tilting lever spring
57 Coupling device
58 Piston
59 Double arrow
60 Adjusting screw
61 Nut
62 Male thread
63 Female thread
64 Collar
65 Spring element
66 Further collar
67 Flange
68 Securing ring
69 Working chamber
70 Arrow
71 Arrow
BB Actuation region

The invention claimed is:

1. A valve actuation device (1) for actuating a first gas exchange valve (2) and a second gas exchange valve (3) of an internal combustion engine, comprising:

a tilting lever (6) which is pivotable around a pivoting axis (9) between a first starting position and a first actuation position;

a valve bridge (10) that is movable between a second starting position and a second actuation position, wherein via the valve bridge (10) both the first gas exchange valve (2) and the second gas exchange valve (3) are actuatable by moving the valve bridge (10) out of the second starting position into the second actuation position; and a coupling device (11) which is switchable between a locking state, in which the valve bridge (10) is movable out of the second starting position into the second actuation position via the coupling device (11) by the tilting lever (6) by moving the tilting lever (6) out of the first starting position into the first actuation position, and an unlocking state, in which, despite a movement of the tilting lever (6) out of the first starting position into the first actuation position, there is no movement of the valve bridge (10) out of the second starting position into the second actuation position that can be caused by the tilting lever (6) via the coupling device (11);

wherein the coupling device (11) is held on the tilting lever (6) such that the coupling device (11) is pivotable around the pivoting axis (9) with the tilting lever (6);

wherein the coupling device (11) has a switching element (12) that is movable in a movement direction (13) in relation to the tilting lever (6) and that is movable in the movement direction (13) in relation to the tilting lever (6) between a locking position causing the locking state and an unlocking position causing the unlocking state; and an actuation element (38), wherein the tilting lever (6) and, with the tilting lever (6), the coupling device (11) and the switching element (12) are pivotable around the pivoting axis (9) in relation to the actuation element (38) and wherein the switching element (12) is movable by the actuation element (38) out of the locking position into the unlocking position by pivoting the tilting lever (6) and the switching element (12) out of the first actuation position into the first starting position.

2. The valve actuation device (1) according claim 1, wherein, by pivoting the tilting lever (6) out of the first actuation position into the first starting position, the actuation element (38) is movable out of an active position, in which the switching element (12) is movable by the actuation element (38) out of the locking position into the unlocking position by pivoting the tilting lever (6) and the switching element (12) out of the first actuation position into the first starting position, into a withdrawal position, in which, despite the tilting lever (6) and the switching element (12) pivoting out of the first actuation position into the first starting position, there is no movement of the switching element (12) out of the locking position into the unlocking position that can be caused by the actuation element (38).

3. The valve actuation device (1) according to claim 2, further comprising a movement element (39) which is held on the tilting lever (6) and which is pivotable around the pivoting axis (9) with the tilting lever (6), wherein the movement element (39) is movable in a switching direction (40) in relation to the tilting lever (6) and in relation to the switching element (12) between a movement position, in which the actuation element (38) is movable by the movement element (39) out of the active position into the withdrawal position by pivoting the tilting lever (6) and the movement element (39) out of the first actuation position into the first starting position, and a rest position, in which, despite the tilting lever (6) and the movement element (39) pivoting out of the first actuation position into the first starting position, there is no movement of the actuation element (38), caused by the movement element (39), out of the active position into the withdrawal position.

4. The valve device (1) according to claim 3, wherein the movement element (39) is movable hydraulically out of the movement position into the rest position.

5. The valve actuation device (1) according to claim 3, further comprising a spring element (50), wherein via the spring element (50) a spring force is providable and wherein via the spring force the movement element (39) is movable out of the rest position into the movement position.

6. The valve actuation device (1) according to claim 1, wherein the actuation element (38) is a spring.

7. A method for operating the valve actuation device (1) according to claim 1, comprising:

pivoting the tilting lever (6) and the switching element (12) out of the first actuation position into the first starting position and, by the pivoting, moving the switching element (12) out of the locking position into the unlocking position by the actuation element (38).

8. An internal combustion engine for a motor vehicle, comprising:

the valve actuation device (1) according to claim 1.

* * * * *